US010670379B2

(12) United States Patent
Rubin

(10) Patent No.: US 10,670,379 B2
(45) **Date of Patent: *Jun. 2, 2020**

(54) LONGITUDINALLY SECTIONED FIREARMS PROJECTILES

(71) Applicant: Darren Rubin, Largo, FL (US)

(72) Inventor: Darren Rubin, Largo, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/449,051

(22) Filed: Mar. 3, 2017

(65) Prior Publication Data

US 2017/0176156 A1 Jun. 22, 2017

Related U.S. Application Data

(63) Continuation-in-part of application No. 15/017,710, filed on Feb. 8, 2016, now Pat. No. 9,921,040, which
(Continued)

(51) Int. Cl.
*F42B 12/36* (2006.01)
*F42B 30/02* (2006.01)
(Continued)

(52) U.S. Cl.
CPC ..... *F42B 12/36* (2013.01); *F42B 5/02* (2013.01); *F42B 12/20* (2013.01); *F42B 12/34* (2013.01);
(Continued)

(58) Field of Classification Search
CPC .... F42B 5/03; F42B 5/145; F42B 8/12; F42B 8/14; F42B 12/34; F42B 12/36;
(Continued)

(56) References Cited

U.S. PATENT DOCUMENTS 14,315 A 2/1856 James
468,580 A 2/1892 Rubin
(Continued)

FOREIGN PATENT DOCUMENTS

DE 3819251 A1 * 12/1989 ..... F42B 12/34
DE 3822775 A1 2/1990
(Continued)

OTHER PUBLICATIONS

International Search Report and Written Opinion received for International Application No. PCT/US2013/038373, dated Jan. 30, 2014, 18 pages.

*Primary Examiner* — James S Bergin
(74) *Attorney, Agent, or Firm* — Dorsey & Whitney LLP

(57) ABSTRACT

The present invention relates to longitudinally sectioned bullets and methods that pertain to a penetrable projectile structured to be discharged from a firearm and comprising at least two separable and penetrable, non-fused individual longitudinal body sections and at least one exterior binding element, including at the frontal region of said penetrable projectile, that holds the at least two non-fused individual longitudinal body sections together until they rupture inside of a target, thereby causing the penetrable individual longitudinal body sections to separate away from each other inside of the target as the projectile penetrates the target. The penetrable projectile is thus capable of controlled fragmentation against a soft target, and is optionally adapted to deliver at least one supplemental payload to a target to further damage said target.

53 Claims, 22 Drawing Sheets

Related U.S. Application Data is a continuation-in-part of application No. 13/477,523, filed on May 22, 2012, now Pat. No. 9,255,775.

(51) Int. Cl.

| | |
|---|---|
| ***F42B 12/54*** | (2006.01) |
| ***F42B 5/02*** | (2006.01) |
| ***F42B 12/40*** | (2006.01) |
| ***F42B 12/20*** | (2006.01) |
| ***F42B 12/34*** | (2006.01) |
| ***F42B 14/02*** | (2006.01) |
| ***F42B 12/46*** | (2006.01) |
| ***F42B 12/60*** | (2006.01) |
| *F42B 5/24* | (2006.01) |

(52) U.S. Cl.

CPC ..... *F42B 12/365* (2013.01); *F42B 12/367* (2013.01); *F42B 12/40* (2013.01); *F42B 12/46* (2013.01); *F42B 12/54* (2013.01); *F42B 12/60* (2013.01); *F42B 14/02* (2013.01); *F42B 5/24* (2013.01); *F42B 30/02* (2013.01)

(58) Field of Classification Search

CPC ..... F42B 12/367; F42B 12/46; F42B 12/54; F42B 12/56; F42B 12/74; F42B 30/02

USPC ..... 102/438, 439, 506, 516, 517, 501, 502

See application file for complete search history.

(56) References Cited

U.S. PATENT DOCUMENTS

| | | | | | |
|---|---|---|---|---|---|
| 948,148 | A | | 2/1910 | Schenk | |
| 3,097,603 | A | * | 7/1963 | Harper | F42B 12/22 102/506 |
| 3,665,861 | A | * | 5/1972 | Jaslow | F42B 5/03 102/506 |
| 4,140,061 | A | | 2/1979 | Campoli | |
| 4,239,006 | A | | 12/1980 | Kelson | |
| 4,242,960 | A | | 1/1981 | Boeder et al. | |
| 4,413,566 | A | | 11/1983 | Loeb et al. | |
| 4,655,140 | A | | 4/1987 | Schirneker | |
| 4,685,397 | A | | 8/1987 | Schirneker | |
| H000770 | H | | 4/1990 | Kline | |
| 4,913,054 | A | | 4/1990 | Petersen | |
| 4,947,755 | A | | 8/1990 | Burczynski | |
| 5,440,994 | A | | 8/1995 | Alexander | |
| 5,505,137 | A | * | 4/1996 | Godefroy | F42B 8/14 102/506 |
| 5,569,874 | A | | 10/1996 | Nelson | |
| 5,679,920 | A | | 10/1997 | Hallis et al. | |
| 5,796,031 | A | | 8/1998 | Sigler | |
| 5,801,324 | A | * | 9/1998 | Pickard | F42B 12/34 102/506 |
| 5,852,255 | A | | 12/1998 | Hallis et al. | |
| 5,852,858 | A | | 12/1998 | Hallis et al. | |
| 5,861,573 | A | * | 1/1999 | Pickard | F42B 12/34 102/506 |
| 6,024,021 | A | | 2/2000 | Schultz | |
| 6,176,186 | B1 | * | 1/2001 | Engel | F42B 12/34 102/506 |
| 6,776,101 | B1 | * | 8/2004 | Pickard | F42B 12/34 102/507 |
| 7,360,491 | B2 | | 4/2008 | Sanborn | |
| 7,380,502 | B2 | | 6/2008 | Emary | |
| 7,748,325 | B2 | * | 7/2010 | Marx | F42B 12/34 102/501 |
| 7,874,253 | B2 | * | 1/2011 | Marx | F42B 12/34 102/506 |
| 7,900,561 | B2 | | 3/2011 | Marx | |
| 8,082,850 | B2 | | 12/2011 | Marx | |
| 8,141,493 | B1 | | 3/2012 | Kuchman | |
| 8,622,001 | B1 | | 1/2014 | Patel et al. | |
| 8,640,622 | B2 | | 2/2014 | Eckstein | |
| 9,255,755 | B1 | | 2/2016 | Barnett | |
| 9,255,775 | B1 | * | 2/2016 | Rubin | F42B 12/36 |
| 9,551,555 | B2 | * | 1/2017 | Flint | F42B 12/367 |
| 9,593,921 | B1 | * | 3/2017 | Kostka | F42B 8/14 |
| 9,921,040 | B2 | * | 3/2018 | Rubin | F42B 12/54 |
| 10,072,914 | B2 | * | 9/2018 | Flint | F42B 12/367 |
| 10,168,131 | B2 | * | 1/2019 | Riess | F42B 12/34 |
| 2003/0145755 | A1 | | 8/2003 | Briese | |
| 2007/0089629 | A1 | | 4/2007 | Marx | |
| 2011/0155014 | A1 | | 6/2011 | Marx | |
| 2011/0259231 | A1 | | 10/2011 | Marx | |
| 2011/0259232 | A1 | | 10/2011 | Marx | |
| 2012/0180686 | A1 | | 7/2012 | Jones et al. | |
| 2016/0161232 | A1 | | 6/2016 | Rubin | |

FOREIGN PATENT DOCUMENTS

| | | | |
|---|---|---|---|
| EP | 0626555 | A1 | 11/1994 |
| FR | 2802296 | A1 | 6/2001 |
| RU | 1794241 | C | 2/1993 |
| WO | 2014018144 | | 1/2014 |
| WO | 2014018144 | A2 | 1/2014 |

* cited by examiner

LONGITUDINALLY SECTIONED FIREARMS PROJECTILES

RELATED APPLICATION

The present application is a continuation-in-part of U.S. patent application Ser. No. 15/017,710 filed Feb. 8, 2016, now U.S. Pat. No. 9,921,040, which is a continuation-in-part of U.S. patent application Ser. No. 13/477,523 filed May 22, 2012, now U.S. Pat. No. 9,255,775, the subject matter of which is incorporated herein by reference.

BACKGROUND OF THE INVENTION

Field of the Invention

The present invention relates to longitudinally sectioned bullets and more particularly pertains to a projectile structured to be discharged from a firearm and comprising at least two separable longitudinal body sections and at least one binding element that holds the at least two longitudinal body sections together, such as before impact with a target. Said projectile is thus capable of controlled fragmentation against a soft target. Said projectile adapted to also contain at least one supplemental payload deliverable to a target.

For reference herein, the term "longitudinal" pertains to a measurement in the direction of the long axis of the projectile body. The terms "longitudinally sectioned" projectile or "longitudinal body section" refers to a projectile divided at least somewhat lengthwise, into at least two sections. The projectile is adapted to be divided at least somewhat in the direction of a long axis of the projectile, such as the central primary long axis or another long axis. This division is adapted to run parallel or partially parallel to a long axis of the projectile, but is adapted to also be tilted or skewed by at least one angle and/or by at least one distance from a long axis. Therefore, at least one section is adapted to run the full length of the projectile, or part of the length of the projectile. Furthermore, said longitudinal body sections are adapted to be symmetrical or nonsymmetrical with respect to each other. Therefore, the body of a longitudinally sectioned projectile comprises at least two body sections with at least one surface interior to the bullet body that at least partially runs at least somewhat in the tip-to-rear/front-to-back direction of the projectile. The body of a longitudinally sectioned projectile contains at least two longitudinal body sections.

DESCRIPTION OF THE PRIOR ART

Bullets are projectiles discharged from a firearm, such as a hand gun or rifle. Bullets have the primary function of impacting and penetrating an intended target. Bullets have evolved many times over several centuries, resulting in many improvements, such as modern-day, metal jacketed bullet cartridges, invented by Swiss Major Eduard Rubin in the late 1800s, as described in U.S. Pat. No. 468,580. Cartridges generally consist of a bullet projectile, a case/shell, a propellant, such as gunpowder or cordite, a primer which ignites the propellant once the firearm is triggered, along with an annular groove and flange of the casing, at the back-end of the bullet, that aids in loading the cartridge. Most bullets also contain a metal jacket, such as a copper jacket. For more than a century, bullets have mostly been comprised of lead, which poses environmental risks.

U.S. Pat. No. 5,801,324 describes a dividing bullet having longitudinally joined, and therefore non-individual, jacketed projectile segments that separate upon target impact, whereby each subprojectile is jacketed and joined together, thereby differing from the present invention. The current invention is also not limited to just two body sections. Unlike the current invention, this patent does not include an outer binding element.

U.S. Pat. No. 5,861,573 describes a dividing bullet with weakened longitudinal seam for separating into halves upon impact with target, said seam is comprised of a material weaker in strength than the material making up said pair of halves of said projectile body. The current invention does not have such a joint of seam-like material bonded between said body sections. The current invention is also not limited to just two body sections. Unlike the current invention, this patent does not include an outer binding element.

German Application DE3822775 A1 describes a projectile cut partially into sectors, but these sectors are still firmly interconnected together, and non-cut in the center; they have a center-related joint. Likewise, German Application DE3819251 A1 describes sectors connected together with solder, glue, or binders between them, so they too are not individual sectors, but fused together along the interior of the projectile, unlike the current invention. In both German Applications, the projectile is exposed with no exterior element at its front and there is a missing hard tip, unlike the current invention. Also, these sectors immediately blow up and separate at impact by catching on target skin with their cutting edge and missing tip, which happens before penetration, unlike the current invention, to greatly reduce penetration depth.

U.S. Pat. No. 6,776,101 describes a bullet with a long central aperture that extends less than the full length of the bullet body, which differs from the current invention. Unlike the current invention, this patent does not include an outer binding element.

U.S. Pat. No. 7,380,502 describes a bullet with a forward end cavity and a nose element of resilient/elastomeric material that is received into this frontal cavity. The purpose of this softer pointed tip is to prevent the accidental triggering of the primer of another cartridge in front of this cartridge, when stored in a tubular magazine, such as in a rifle; while maintaining aerodynamic efficiency. The soft point nose/tip is held firmly in place by the jacket.

More recently, there has been a movement to use metals and alloys other than lead in bullet production, to be environmentally friendly. Other materials optionally consist of tungsten and tin. So called "green bullets" can have equivalent performance to lead filled projectiles. If denser materials than lead are used, such a projectile of increased weight is adapted to be attributed with increased terminal energy and energy delivered to a target. Greater density is adapted to also improve the ballistic coefficient to help maintain initial velocity and improve projectile range and accuracy. There are also additional ways to improve projectile performance, such as bullets having an exterior surface that engages the rifling of a firearm with a reduced contact area. By reducing the contact area of the projectile with the barrel, barrel friction and heat can be reduced, projectile performance can be enhanced, and the wear on barrel life can be reduced.

U.S. Pat. Nos. 7,748,325 and 7,874,253 describe a bullet with the ability to carry a supplemental payload, without any claim to what that supplemental payload is. Furthermore, U.S. Pat. Nos. 7,748,325 and 7,874,253 describe a bullet with three sections; a nose portion, a tail portion, and an intermediate interface portion. The nose portion and tail portion are divided laterally, in the direction perpendicular to the long axis of the projectile. This intermediate interface portion connects the nose and tail portions, and is designed to rupture, after projectile penetration, once the projectile begins to "tumble" inside of a soft target, thereby, separating the nose and tail portions. The present invention differs from this respect. The present invention provides controlled fragmentation of longitudinal sections, beginning at impact. The present invention is adapted to also negate the need for tumbling inside of a soft target for separation of sections to occur.

U.S. Pat. No. 7,900,561 describes a projectile comprising a leading part formed by a tip, a trailing part formed by a main base, a trailing rod, and a leading end of a cylindrical interface.

U.S. Pat. No. 8,082,850 describes a projectile comprising a leading part formed by a tip, a trailing part formed by a base, and an annular shoulder, and a cylindrical rod.

U.S. Application Number US20110155014 describes a projectile having a leading part, a trailing part, and a cylindrical interface that interconnects the leading and trailing parts.

U.S. Application Number US20110259231 describes a round of ammunition comprising a cartridge with a hollow projectile having a trailing end slideably disposed within said cartridge and a flattened leading end.

U.S. Application Number US20110259232 describes a projectile having a leading end, a trailing end base, and a cylindrical mid-section interconnecting the tip and base, along with a thermoset polymer guide.

Therefore, it can be appreciated that there exists a continuing need for new and improved longitudinally sectioned bullets. In this regard, the present invention substantially fulfills this need.

SUMMARY OF THE INVENTION

In view of the foregoing disadvantages inherent in the known types of bullet cartridges and projectiles of known designs and configurations now present in the prior art, the present invention provides improved longitudinally sectioned bullets. As such, the general purpose of the present invention, which will be described subsequently in greater detail, is to provide new and improved longitudinally sectioned bullets which has all the advantages of the prior art and none of the disadvantages.

To attain this, the present invention is essentially a bullet projectile comprised of at least two longitudinal body sections, said projectile further comprised of at least one binding element that holds the at least two longitudinal body sections together at least before impact with a target, thus allowing controlled fragmentation of the sections in the target. The at least one binding element is preferably rupturable upon impact. The bullet is adapted to also contain at least one partial bullet jacket. In some embodiments, at least one binding element is an at least partial bullet jacket. The bullet is adapted to also contain and be able to deliver to a target at least one supplemental payload, chosen from the supplemental payloads including electronic circuit, tracking transmitter, tracer element, and other chemical substance. The said bullet is capable of being fired as a projectile from a firearm. Cartridges containing said bullet projectiles would be available as ammunition and produced in all calibers, such as from 0.17 through 50 BMG calibers. Said ammunition cartridges are adapted to contain the bullet, a case/shell, a propellant, such as gun gunpowder or cordite, a primer which ignites the propellant once the firearm is triggered, along with an annular groove and flange of the casing, at the back-end of the bullet, that aids in loading the cartridge.

The present invention also includes methods associated with manufacturing this bullet and cartridge. The present invention also includes methods of storing said bullet, loading said bullet into a magazine or firearm, and discharging said bullet from a firearm at a target.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide new and improved longitudinally sectioned bullets which has all of the advantages of prior art bullets of known designs and configurations and none of the disadvantages.

It is another object of the present invention to provide new and improved longitudinally sectioned bullets, and cartridges, which may be easily and efficiently manufactured and marketed.

It is further object of the present invention to provide new and improved longitudinally sectioned bullets which are of durable and reliable constructions.

An even further object of the present invention is to provide longitudinally sectioned bullets which are susceptible of a low cost of manufacture with regard to both materials and labor, and which accordingly are then susceptible of low prices of sale, thereby making such longitudinally sectioned bullets economical.

Even still another object of the present invention is to provide longitudinally sectioned bullets for delivering at least one supplemental payload to the intended target.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
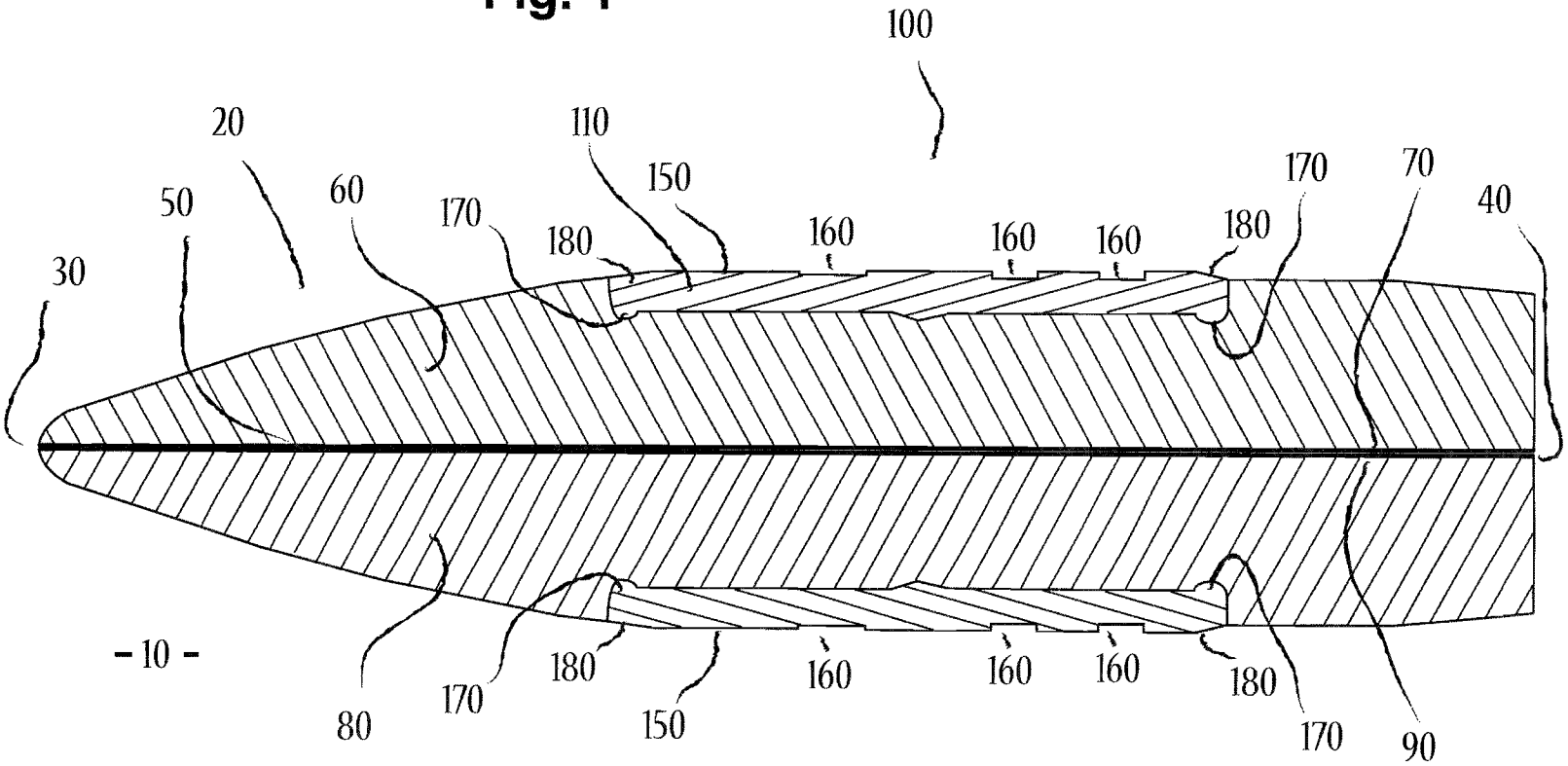
FIG. 1 is a first embodiment of a new and improved longitudinally sectioned bullet, shown as a longitudinal cross-section, and revealing two longitudinal sections, along with one binding element that at least partially jackets the mid-section of the bullet and holds the longitudinal body sections together.

With reference now to the drawings, and in particular to FIG. 1 thereof, the first embodiment of the new and improved longitudinally sectioned bullet embodying the principles and concepts of the present invention and generally designated by the reference numeral 10 will be described.

The present invention, the longitudinally sectioned bullet 10 is comprised of a plurality of components. Such components in their broadest context include a bullet body 20, with a front tip region 30 and a rear end or distal region 40 opposite the tip. A primary central longitudinal axis 50 spanning the length of the projectile, from the bullet tip 30 to its rear 40. A first longitudinal section 60 of the bullet body 20 has an internally facing surface 70. A second longitudinal section 80 of the bullet body 20 has an internally facing surface 90. In this embodiment, longitudinal sections 60 and 80 represent two halves of bullet body 20 divided longitudinally along primary central longitudinal axis 50 in which their internally facing surfaces 70 and 90 meet. Longitudinal sections 60 and 80 are adapted to be formed of a high density metal matrix composite chosen from the class of high density metal matrix composites including metals, alloys, and ceramics. More specifically, longitudinal body sections can each be formed from a material which contains at least one material chosen from the class of materials including aluminum, antimony, beryllium, bismuth, boron carbide, brass, bronze, chromium, cobalt, copper, gold, iridium, iron, lead, magnesium, mercury, molybdenum, nickel, palladium, platinum, rhodium, silicon carbide, silver, steel, tantalum, tellurium, tin, titanium, tungsten, tungsten carbide, depleted uranium, zinc, zirconium, metal alloys, carbon-fiber, polymers, polymer-metal composites, thermoplastic and metal powders.

Next is a central region 100 of the bullet body located somewhere between bullet tip 30 and bullet rear 40. Further included is at least one binding element that holds the longitudinal sections together before impacting a target. In this first embodiment, a tubular binding element, or annular shoulder, 110 encompasses the longitudinal sections 60 and 80 of bullet body 20 within this central region 100. The binding element can be made from metal alloys or polymers, including materials which contain at least one of the following: aluminum, bronze, brass, chromium, copper, epoxy, fiberglass, Kevlar, gold, graphite, iron, lead, magnesium, mercury, molybdenum, nickel, nylon, palladium, polycarbonate, polyester, polyethylene, polystyrene, polyamide, poly vinyl chloride, polyurethane, phenolic, thermoplastic polymer, thermoset polymer, rhodium, rubber, silicon, silver, steel, tantalum, tellurium, tin, titanium, Teflon, Torlon, Ultem, zinc, zirconium, metal alloys, carbon-fiber, polymers, polymer-metal composites, thermoplastic and metal powders. The binding element is adapted to be rupturable upon target impact so that longitudinal body sections separate. The binding element is adapted to also serve as an at least partial bullet jacket.

This binding element in many of the preferred embodiments of the present invention can be disposed in interconnecting relation to the longitudinal sections. As such, this centrally located binding element or partial jacket 110, has an at least partially hollow interior 120 and an open ended construction defined by at least one but preferably both oppositely disposed open ends 130 and 140, which are cooperatively dimensioned and configured to receive longitudinal sections of the bullet body. Insertion of longitudinal sections 60 and 80 and the fixed or removable connection to the binding element 110 can be accomplished by a friction, press fitted securement as the connecting portions of longitudinal sections pass into the at least partially hollow interior 120 through the open ends 130 and 140 of binding element 110.

Moreover, the press fitted insertion of the longitudinal sections 60 and 80 into the binding element 110 is adapted to be structured to define either a fixed connection or a removable connection. With a firm, secure but removable connection, a separation of the bullet body longitudinal sections 60 and 80 from one another and possibly from the binding element 110 is facilitated when the projectile body 20 strikes at least one predetermined category of targets such as, but not necessarily limited to, a soft target. More specifically, when the projectile body 20 impacts and begins to penetrate a soft target, such as, but not limited to a human or animal, longitudinal sections separate, due at least in part to the forces exerted on the projectile body 20 and the structural features of the binding element 110, the binding element will separate or rupture upon impact and penetration.

An additional operative feature of the binding element 110 in accord with its disposition and structure is directed to the exterior surface 150 thereof which defines a reduced, primary contact and/or substantially exclusive contact area between the projectile body 20 and the rifling or interior surface of the barrel of the firearm from which it is discharged. The significantly reduced area of contact between the projectile body and the rifling of the barrel, than that of a traditional jacketed bullet, results in significantly reduced bore friction and heat buildup. As a result, barrel performance is improved during sustained fire of the firearm thereby increasing the barrel life and reducing the occurrence of fouling. An at least partially irregular exterior surface 150 is adapted to further include a plurality of recessed, spaced apart, annular grooves 160 integrally formed in the exterior surface 150. Such annular grooves 160 is adapted to engage or respond to the rifling of the firearm.

As set forth above, the connection between the binding element 110 and the longitudinal sections 60 and 80 is adapted to be fixed. As such, the longitudinal sections 60 and 80 separate from one another by the fact that the binding element 110 ruptures upon striking the target and/or during penetration. Accordingly, the structural and operational features of the projectile 10 provide a controlled fragmentation when the projectile body 20 strikes at least a predetermined target, such as a soft material target including a human, animal, etc. The projectile 10 is adapted to also provide significantly greater penetration against hard targets than projectiles as conventionally structured.

Yet another feature associated with the various preferred embodiments of the present invention is the existence of a firm, secure interconnection between the binding element 110 and each of the longitudinal sections 60 and 80 respectively. This secure and fixed engagement between the binding element 110 and the longitudinal bullet body sections 60 and 80 can be facilitated by inwardly directed, somewhat interior peripheral rims 170 located at opposite ends of the binding element 110. Such a secure connection or attachment between the binding element and longitudinal sections will assure that all these components rotate with one another as the projectile passes through the barrel and thereafter as the projectile exits the barrel. Such rotation is further defined by the binding element and longitudinal bullet body sections all rotating in a common direction and in a synchronized manner such that rotation of all portions of the projectile rotate while being fixedly secured to one another such that the rotation of the projectile is "synchronized". Moreover, any movement or "slippage" of the binding element and bullet body longitudinal sections relative to one another during the flight of the projectile is prevented as the projectile rotates during travel through the barrel and during flight thereafter.

Yet another feature of at least one of the preferred embodiments of the present invention includes the binding element 110 having a tapered or other appropriate configuration generally indicated as 180 located at least at one end thereof. As such, the tapered configuration 180 facilitates or aids in the aerodynamic configuration of the entire projectile 10 thereby facilitating the flight of the projectile 10 after it leaves the barrel of the firearm. Such tapered configuration not only facilitates the aerodynamic flight of the projectile 10, but further serves to at least partially enclose and facilitate gripping engagement of the binding element 110 with the bullet body longitudinal sections, such as 60 and 80, as longitudinal sections are connected to and extend within the interior of the binding element 110.

Now that the first embodiment of the invention has been described, additional embodiments now follow.

Figure 2:
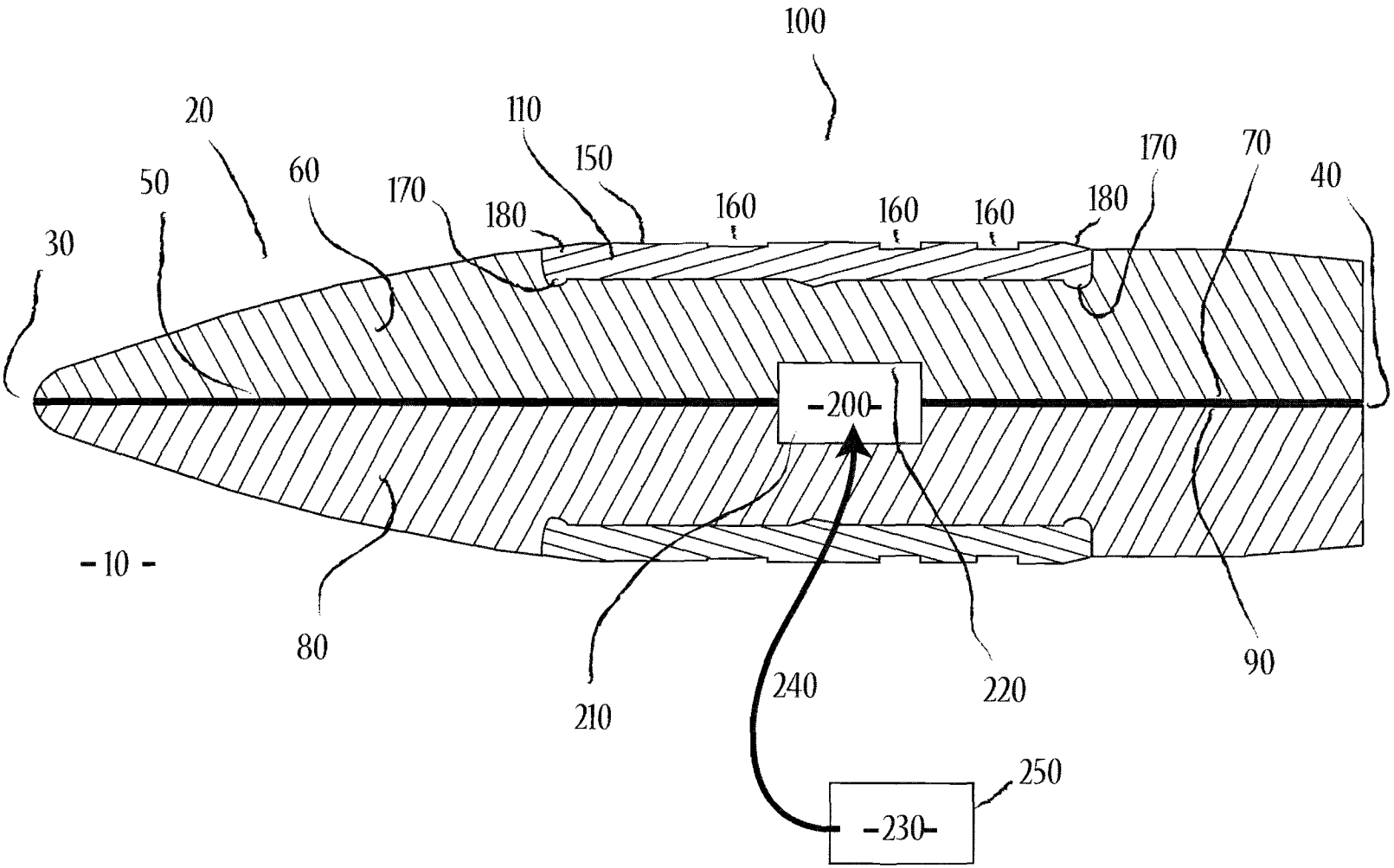
FIG. 2 shows the cross-section of a second bullet embodiment, similar to that of FIG. 1, but with an associated supplemental payload contained in a central cavity shared by both longitudinal sections.

FIG. 2 shows the cross-section of a second bullet embodiment, similar to that of FIG. 1, but with an associated supplemental payload contained in a central cavity shared by both longitudinal sections. Another operative feature of at least some additional embodiments of the projectile 10, such as represented in FIG. 2, comprises the provision of a recess or cavity generally indicated as 200 within the bullet body 20. In this second embodiment, the recess or cavity 200 is formed between recesses 210 and 220 of longitudinal sections 60 and 80, along their internally facing surfaces 70 and 90. The combined recess or cavity 200 is structured and capable of containing and carrying at least one supplemental payload 230. Directional arrow 240 describes where supplemental payload 230 goes inside the bullet body cavity 200. The at least one supplemental payload is adapted to include, but is not limited to, at least one electronic circuit chosen from the class of tracking components including a tracking transmitter, RFID tag, tracer element, dye, isotope, SPLAT, Sticky Polymer Lethal Agent Tag, Smartdust, and other chemical substances and compositions, and any combination thereof. The controlled fragmentation of the bullet body allows this supplemental payload to be delivered to and exposed within a target, such as a soft target such as a human, thereby having an intended action or effect. The supplemental payload 230 is adapted to also comprise a protective outer casing 250 to protect the supplemental payload, such as during bullet impact with the target. This outer casing 250, is adapted to itself, be frangible or dissolvable, to release supplemental payload contents into the soft target.

Figure 3:
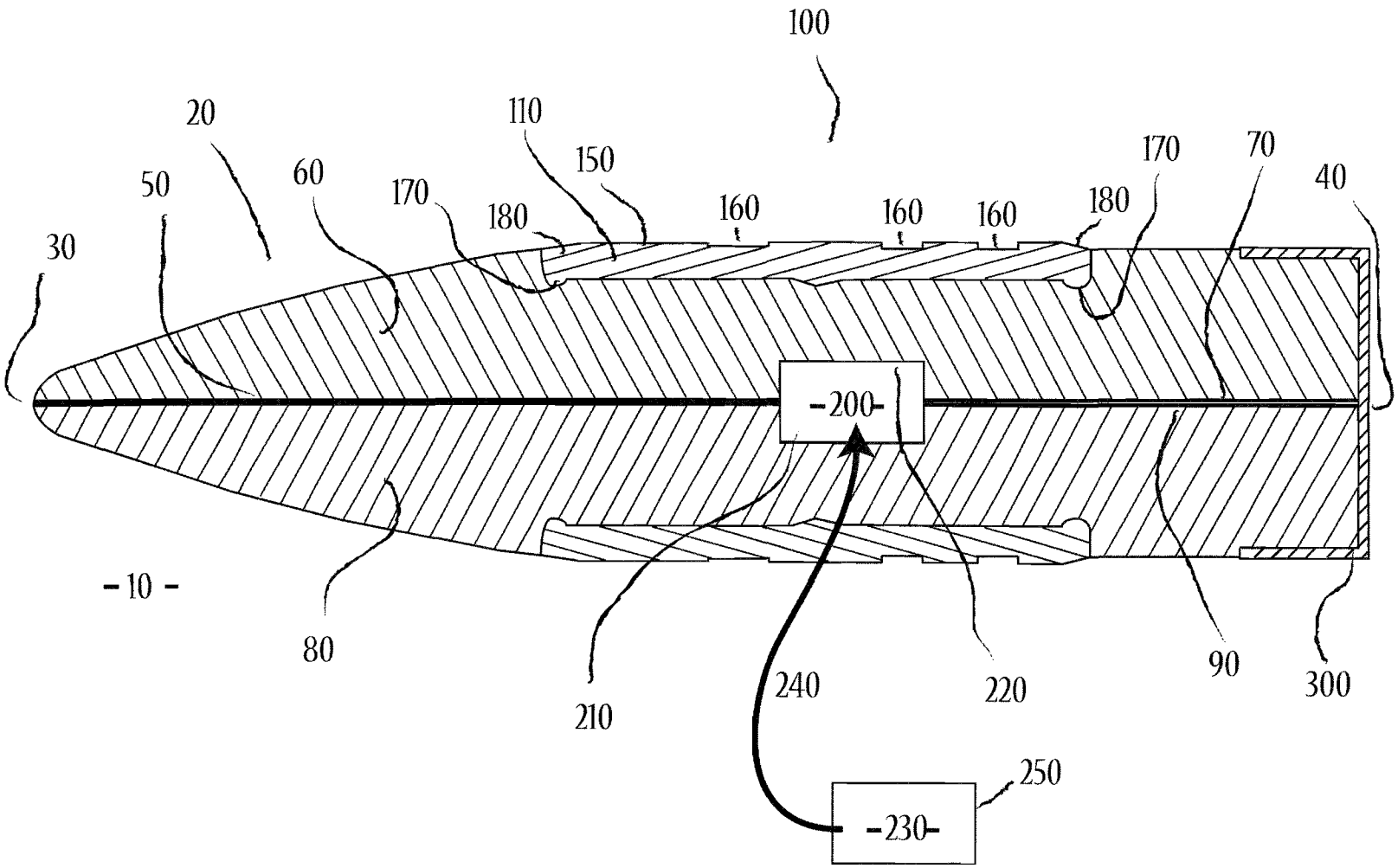
FIG. 3 shows the cross-section of a third bullet embodiment, similar to that of FIG. 2, but also includes a partial jacket or binding element at the rear-end of the bullet, in addition to the partial jacket or binding element at the mid-section.

FIG. 3 shows the cross-section of a third bullet embodiment, similar to that of FIG. 2, but also including a partial jacket or binding element 300 at the rear-end 40 of the bullet body 20. This rear partial jacket or binding element 300 is adapted to be cup-shaped. This rear partial jacket or binding element 300 is adapted to also provide additional structural support to the separable bullet body 20, such as during discharge from the firearm, to help prevent separation of longitudinal body sections before impact with a target. As such, this binding element is adapted to be disposed in interconnecting relation to the longitudinal bullet body sections.

Figure 4:
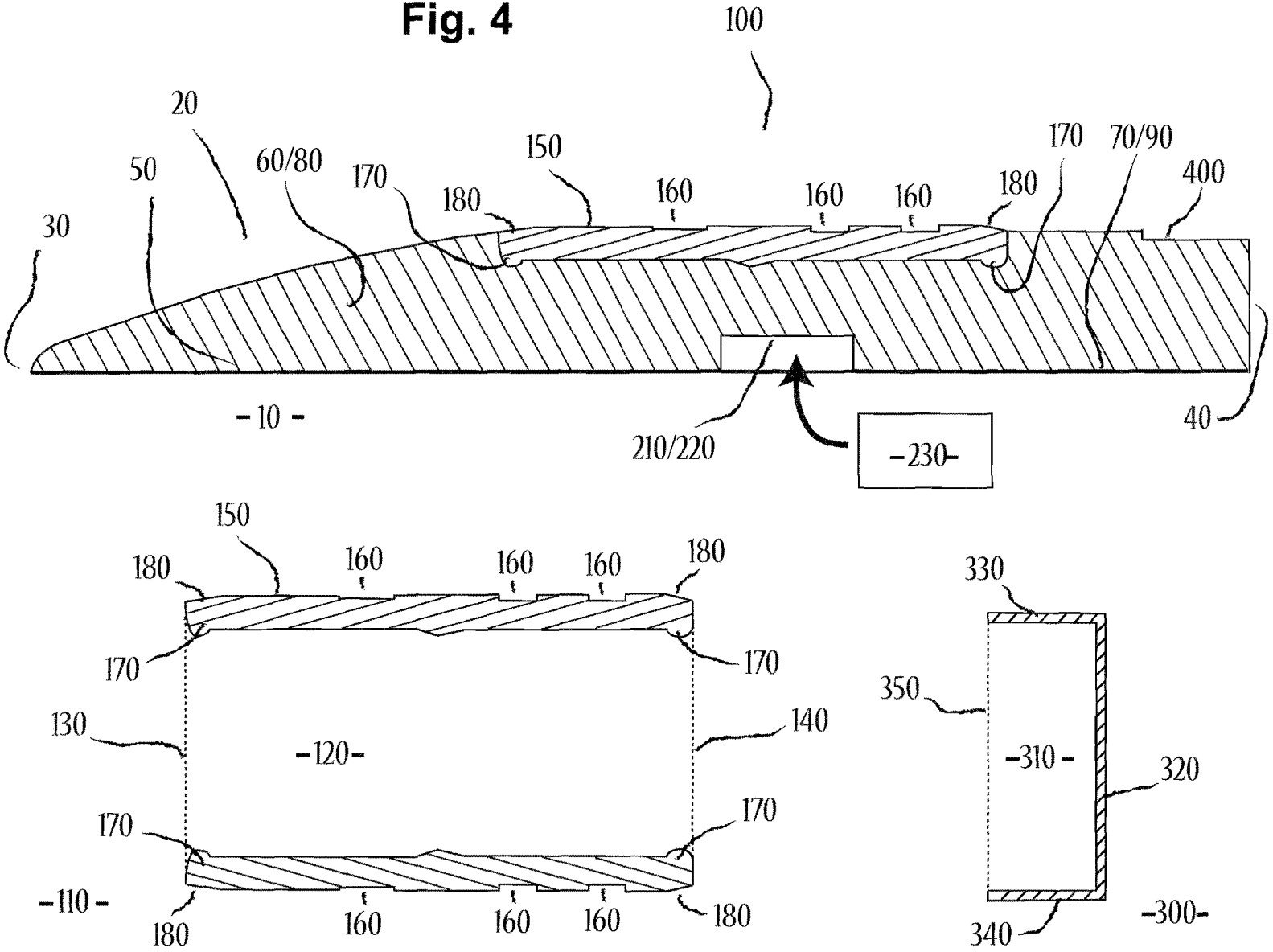
FIG. 4 shows an exploded view of the third bullet embodiment cross-section shown in FIG. 3.

FIG. 4 shows an exploded view of the cross-section of the third bullet embodiment shown in FIG. 3. As can be seen in FIG. 4, rear partial jacket or binding element 300 has an at least partially hollow interior 310, preferably defined with a rear wall 320, two side walls 330 and 340, and a forward facing open end 350. Rear partial jacket or binding element 300 is dimensioned and configured to receive longitudinal sections 60 and 80 of the bullet body. Longitudinal sections 60 and 80 are labeled as 60/80 in this figure for convenience. Longitudinal sections 60 and 80 are adapted to further have an indentation or groove 400 to receive partial jacket or binding element 300 without adding additional girth to the bullet body 20. Insertion of longitudinal sections 60 and 80 and the fixed or removable connection to the partial jacket or binding element 300 can be accomplished by a friction, press fitted securement as the connecting portions of longitudinal sections pass into the at least partially hollow interior 310 through the open end 350. Rear partial jacket or binding element is adapted to also be rupturable upon impact.

Figure 5:
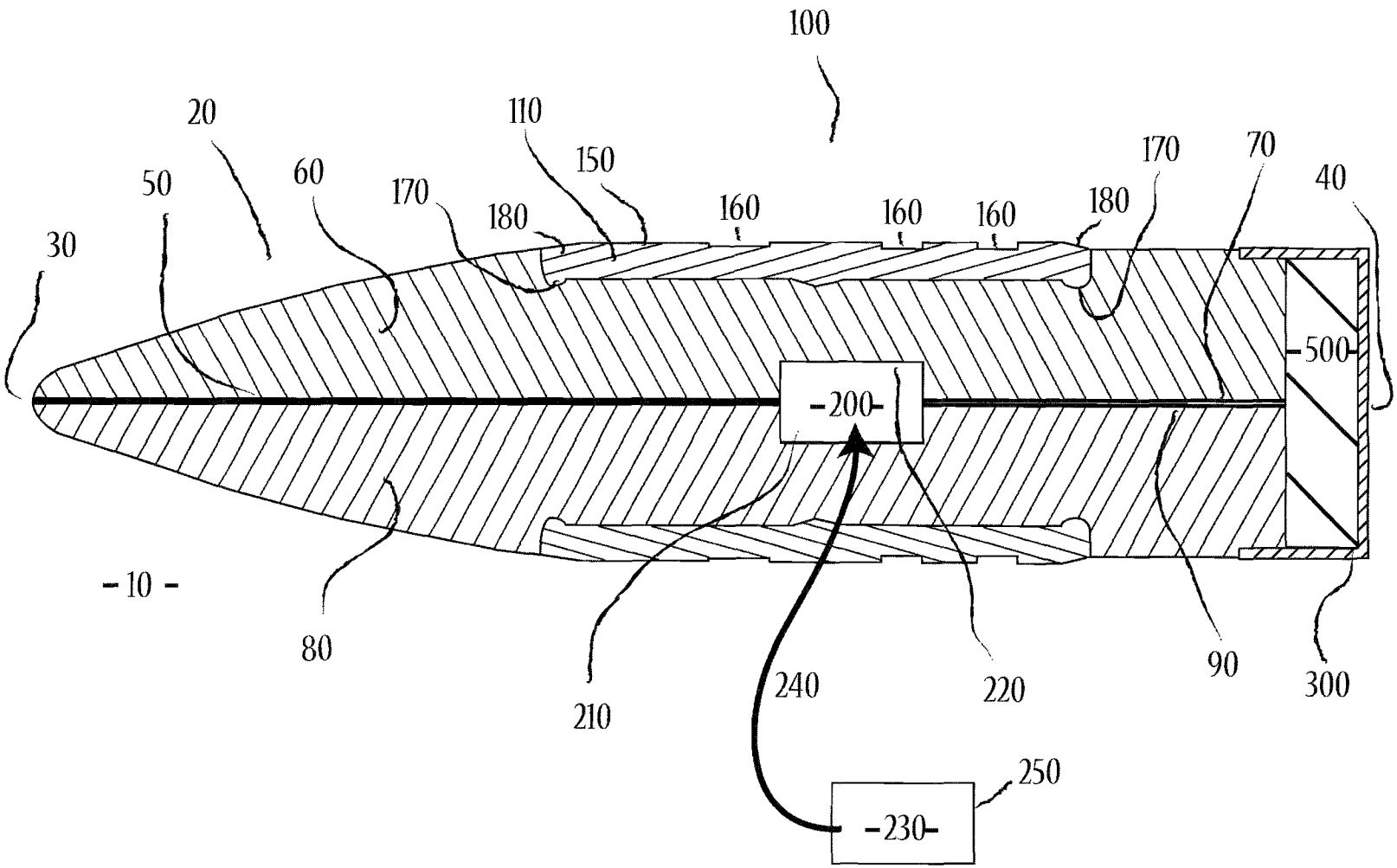
FIG. 5 shows the cross-section of a fourth bullet embodiment, similar to that of FIGS. 3 and 4, but also includes a discharge reinforcing element at the rear-end of the bullet.

FIG. 5 shows the cross-section of a fourth bullet embodiment, similar to that of FIGS. 3 and 4, but also includes a discharge reinforcing element 500 at the rear-end of the bullet. Reinforcing element 500 can exist in a variety of shapes, but is preferably a cylindrical solid. Reinforcing element 500 can further protect longitudinal sections, and supplemental payload(s), from discharge blasts from a cartridge.

Figure 6:
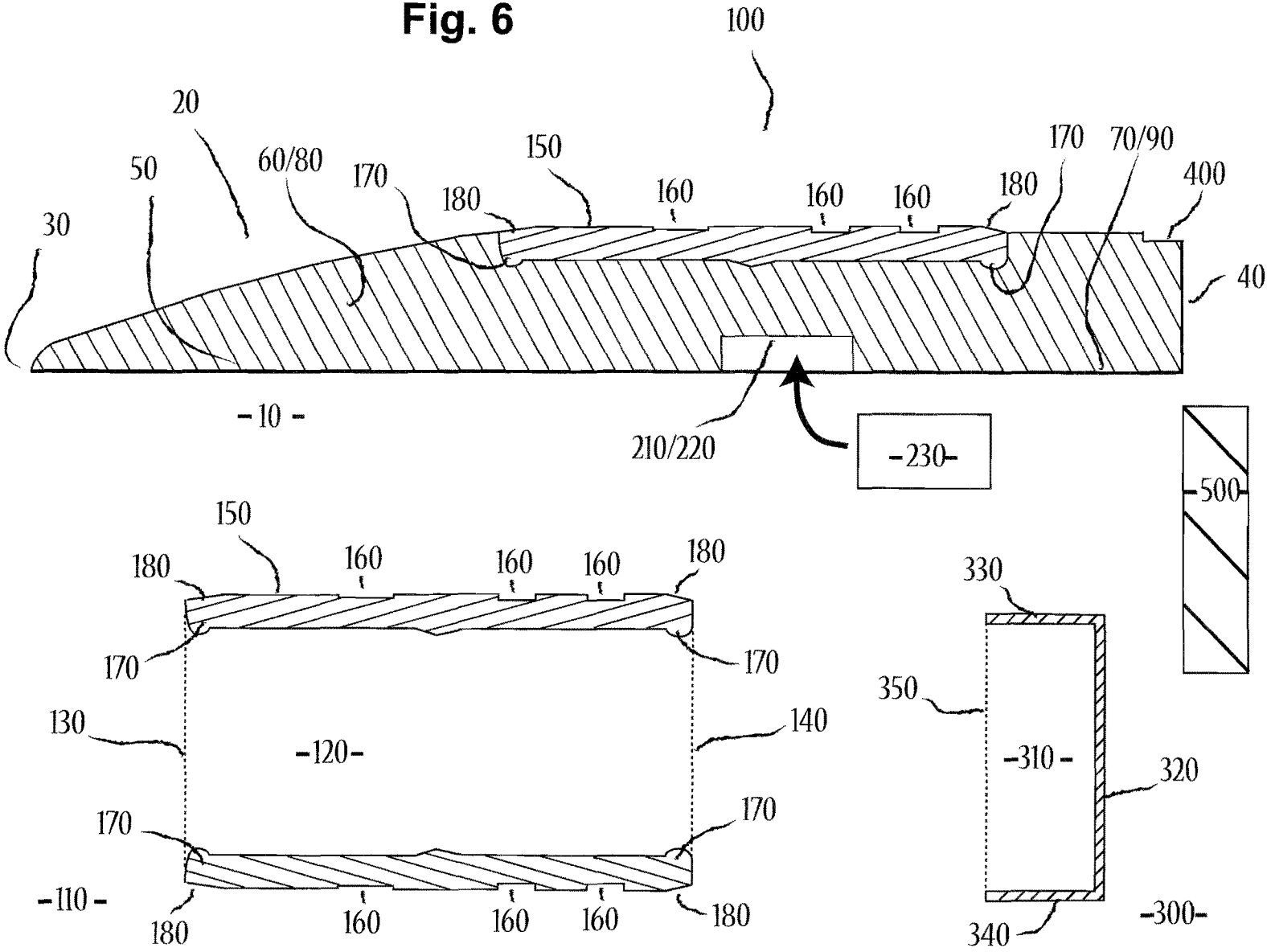
FIG. 6 shows an exploded view of the fourth bullet embodiment cross-section shown in FIG. 5 with discharge reinforcing element.

FIG. 6 shows an exploded view of the cross-section of the fourth bullet embodiment shown in FIG. 5. Longitudinal sections 60 and 80 are labeled as 60/80 in this figure for convenience. Note that in this fourth embodiment, longitudinal sections 60 and 80 have been shortened at their rear end by a length similar to that of the dimension of reinforcement element 500, to accommodate and make room for said reinforcement element 500. Other reinforcements optionally appear at various other locations throughout the bullet body, and the current embodiment should not be construed as limiting.

Figure 7:
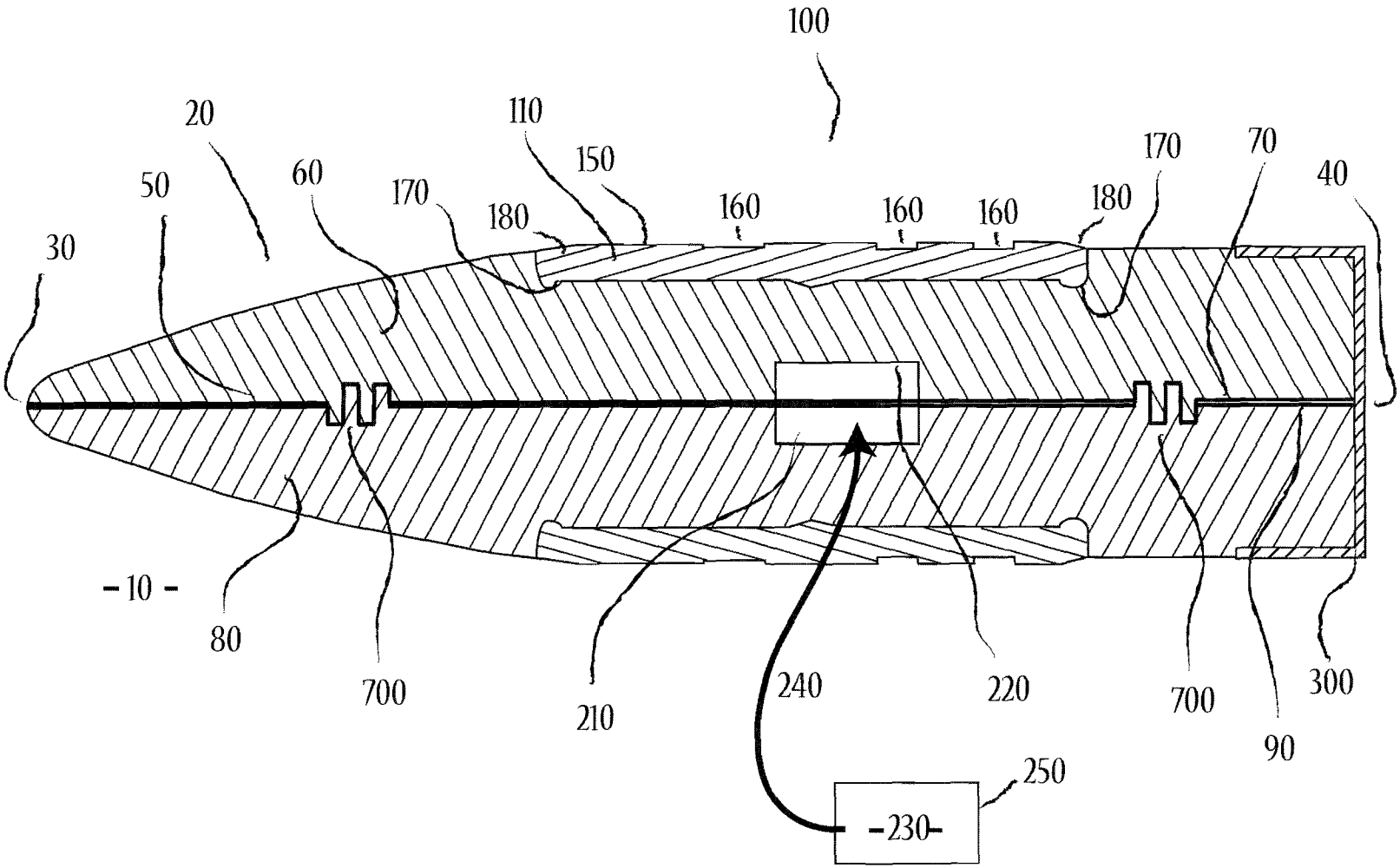
FIG. 7 shows the cross-section of a fifth bullet embodiment, similar to that of FIGS. 3 and 4, but also includes two sets of at least partially interlocking prongs along the surface shared between the two longitudinal sections.

FIG. 7 shows the cross-section of a fifth bullet embodiment, similar to that of FIGS. 3 and 4, but also includes at least one set, in this figure two sets, of at least partially interlocking prong-like elements 700 along internally facing surfaces 70 and 90 of longitudinal sections 60 and 80. These partially interlocking prong-like elements 700 provide additional structural support to the bullet body 20 to help hold longitudinal sections 60 and 80 together, such as before impact, and is adapted to also allow for deeper target penetration before separation.

Figure 8:
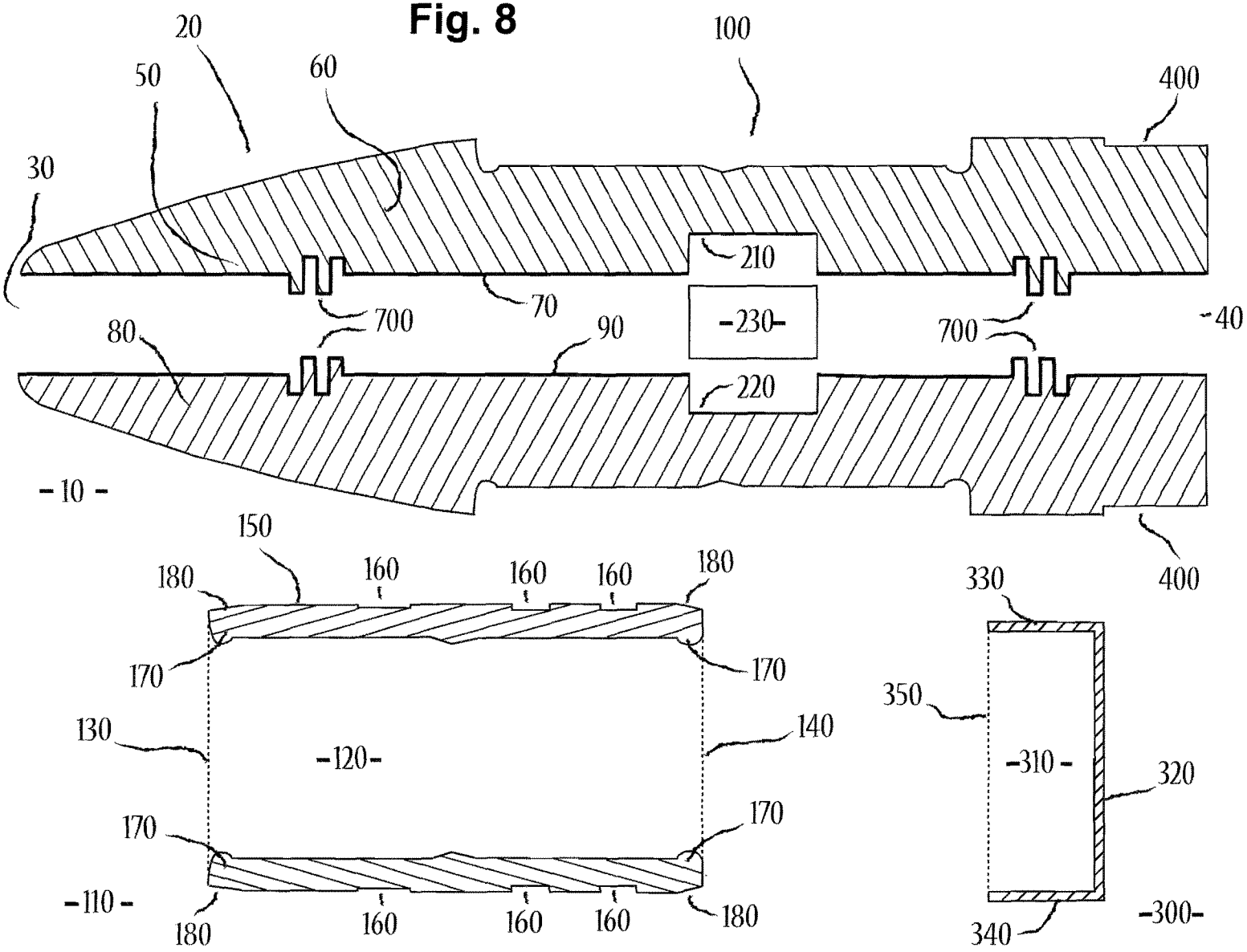
FIG. 8 shows an exploded view of the fifth bullet embodiment cross-section shown in FIG. 7.

FIG. 8 shows an exploded view of the cross-section of fifth bullet embodiment as described in FIG. 7.

Figure 9:
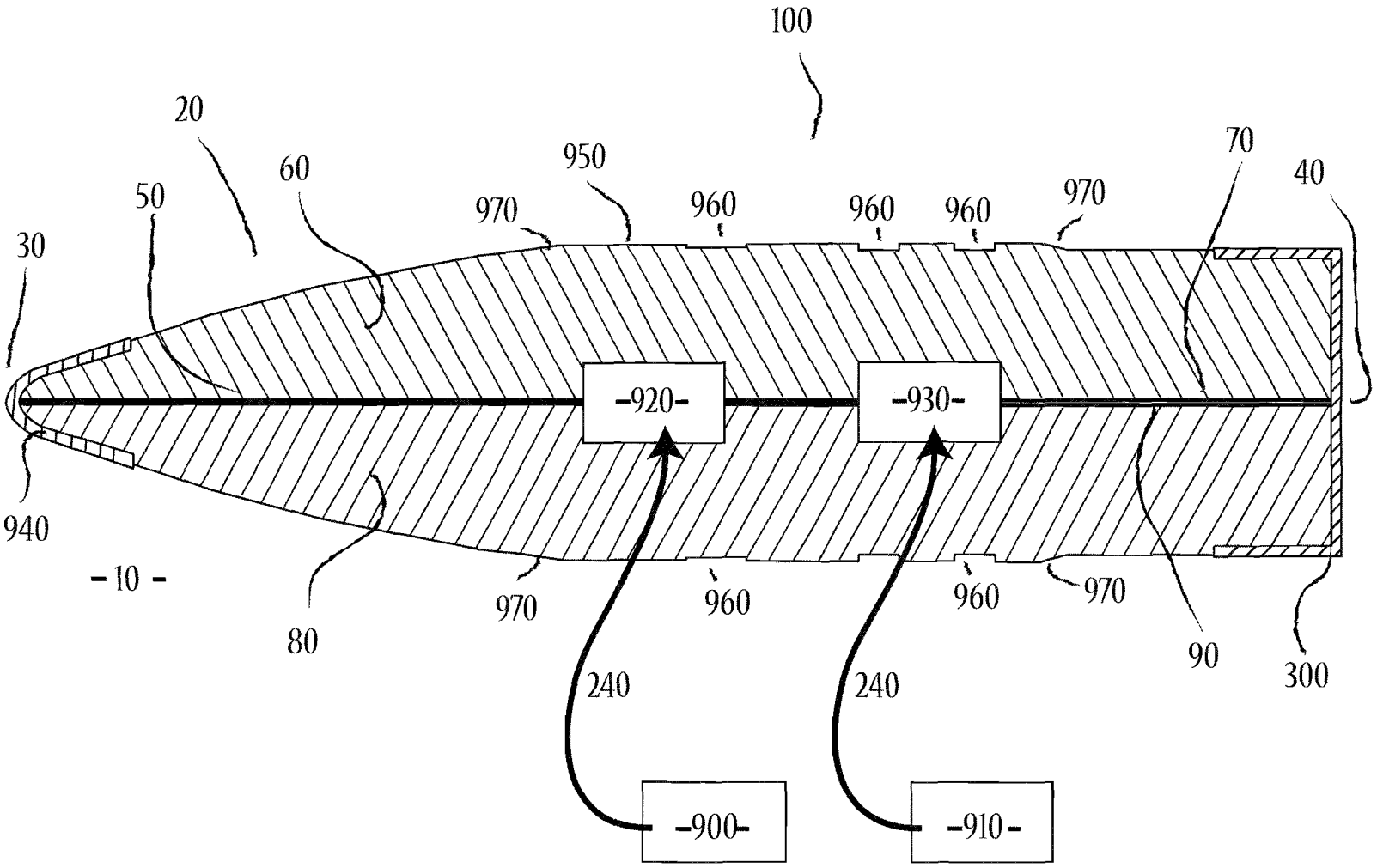
FIG. 9 shows a sixth alternative embodiment of a longitudinally sectioned bullet, shown as a longitudinal cross-section, and revealing two longitudinal sections associated with two different supplemental payloads contained in two central cavities shared by both longitudinal sections. This embodiment includes two binding elements or partial jackets, one at the tip of the bullet, and one at the rear of the bullet, but none at the mid-section of the bullet.

FIG. 9 shows a sixth alternative embodiment of a longitudinally sectioned bullet 10, shown as a longitudinal cross-section, and revealing two longitudinal sections 60 and 80 associated with two different supplemental payloads 900 and 910 contained in two central cavities 920 and 930 shared by both longitudinal sections 60 and 80. The two supplemental payloads can represent any combination of supplemental payloads. For example, the first supplemental payload 900 is adapted to consist of explosive material and the second supplemental payload 910 is adapted to consist of a remote detonator. In another example, the first supplemental payload is adapted to consist of an RFID tag and the second supplemental payload is adapted to consist of at least one chemical substance. In yet another example, the first supplemental payload is adapted to consist of at least one electronic circuit, forming an electronic device, such as a transmitter, while the second supplemental payload is adapted to consist of a power source, such as a battery. Such examples are not meant to be limiting. It can be envisioned that an at least one supplemental payload chosen from the class of supplemental payloads including an electronic device, chemical substance, and composition, able to fit into bullet body cavities, and be carried and deposited into a target, such as a soft human target.

This sixth alternative embodiment further includes two binding elements/partial jackets, one at/near the tip or frontal region of the bullet 940, and one at the rear of the bullet 300, but none at the midsection of the bullet, such as no central binding element 110. Instead, the central 100 exterior surface 950 of the bullet body 20 of longitudinal sections 60 and 80 itself has annular grooves 960, which are adapted to engage the rifling of the firearm, as well as, tapered slopes 970, to facilitate or aid in the aerodynamic configuration of the entire projectile 10 thereby facilitating the flight of the projectile 10 after it leaves the barrel of the firearm. The bullet 10 of this embodiment is structured to have an exterior surface 950 which defines a reduced, primary contact and/or substantially exclusive contact area between the projectile body 20 and the rifling or interior surface of the barrel of the firearm from which it is discharged. The significantly reduced area of contact between the projectile body and the rifling of the barrel, than that of a traditional jacketed bullet, results in significantly reduced bore friction and heat buildup.

Figure 10:
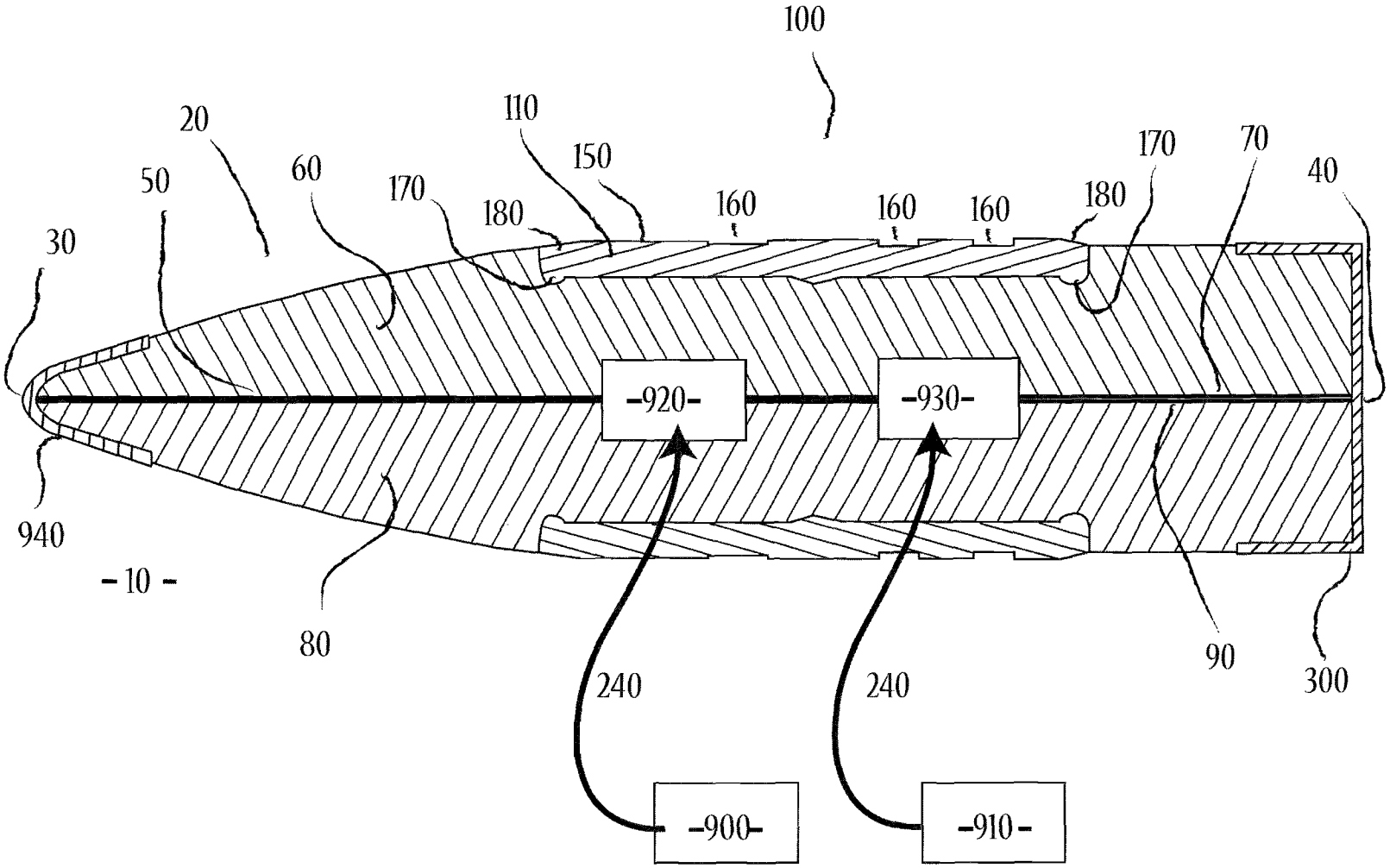
FIG. 10 shows the cross-section of a seventh bullet embodiment, similar to that of FIG. 9, with two supplemental payloads, but contains three binding elements or partial jackets, one at the tip, mid-section, and rear of the bullet.

FIG. 10 shows the cross-section of a seventh bullet embodiment, similar to that of FIG. 9, with two supplemental payloads 900 and 910, but containing three binding elements/partial jackets, one at the tip 940, mid-section 110, and rear of the bullet 300.

Figure 11:
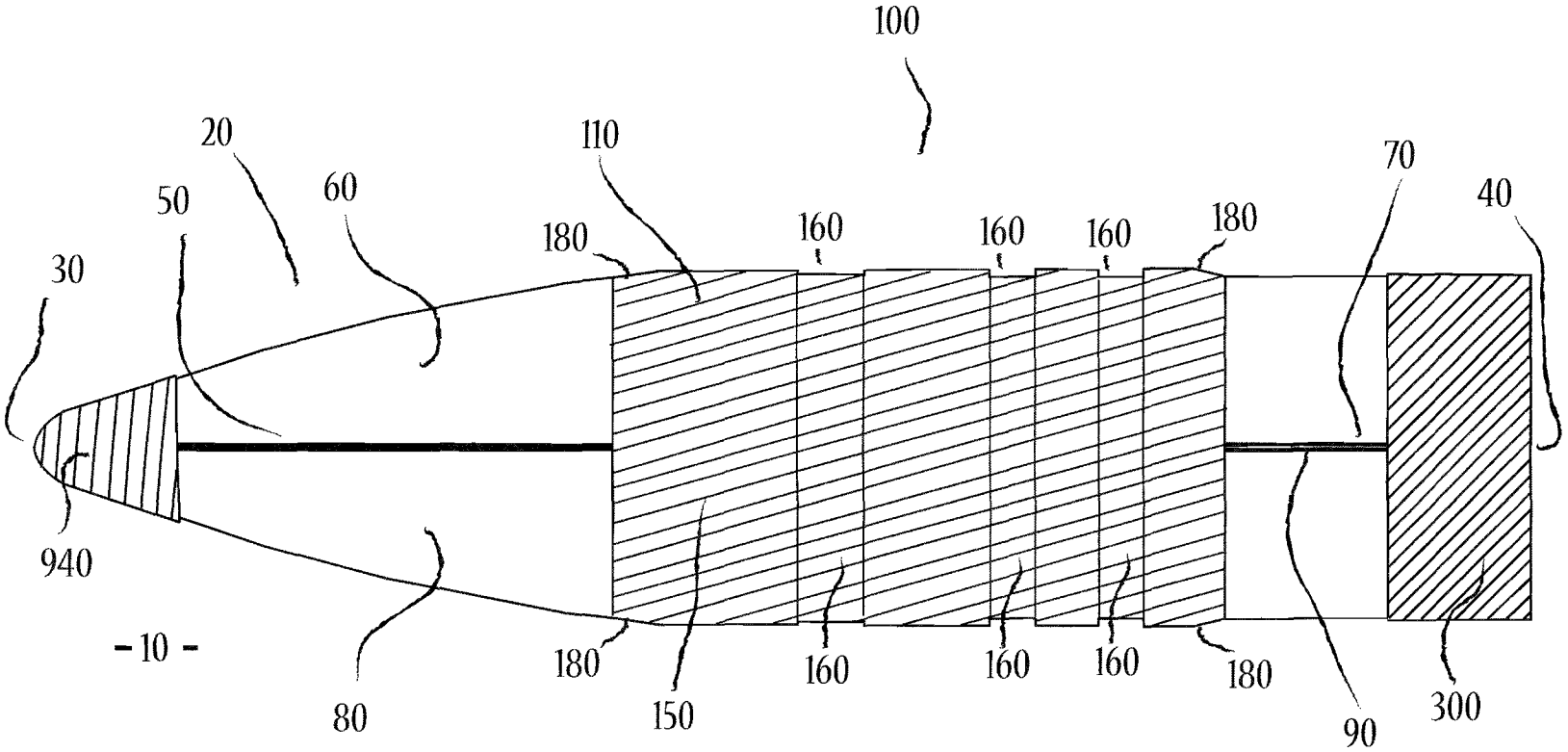
FIG. 11 shows a side perspective of the seventh bullet embodiment described by FIG. 10.

FIG. 11 shows a side perspective of the seventh bullet embodiment described by FIG. 10. This FIG. 11 shows the binding element or partial jacket 940 as a conical tip of the bullet body 20, shows binding element or partial jacket 110 as a tubular sheath around the mid-section of the bullet body, and shows binding element or partial jacket 300 as a cup or cap on the rear end of the bullet body. This figure also shows more detail to the annular grooves 160 integrally formed in the exterior surface 150 of binding element or partial jacket 110. Such annular grooves 160 are adapted to engage or respond to the rifling of the firearm.

Figure 12:
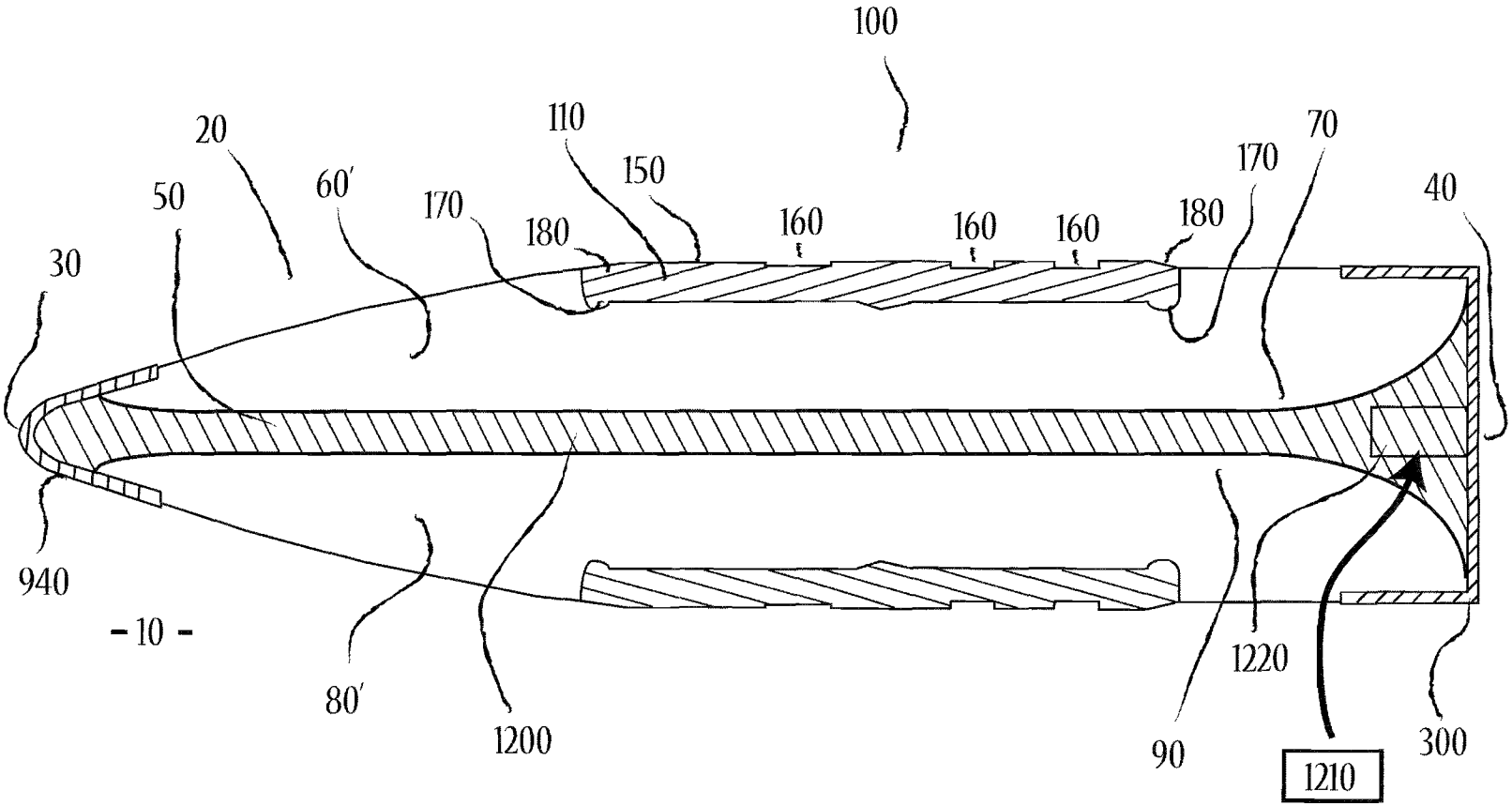
FIG. 12 shows an eighth alternative embodiment of a longitudinally sectioned bullet, shown as a longitudinal cross-section, and containing three bullet longitudinal sections, two side longitudinal sections and a central post section containing a rear supplemental payload. Also shown are three binding elements or partial jackets, one at the tip, mid-section, and rear of the bullet.

FIG. 12 shows an eighth alternative embodiment of a longitudinally sectioned bullet, shown as a longitudinal cross-section, and containing three bullet longitudinal sections, side longitudinal sections 60' and 80' and a central post section 1200 containing a rear supplemental payload 1210 in its rear cavity 1220. This eighth alternative embodiment also contains three binding elements or partial jackets, one at the tip 940, mid-section 110, and rear of the bullet 300.

Figure 13:
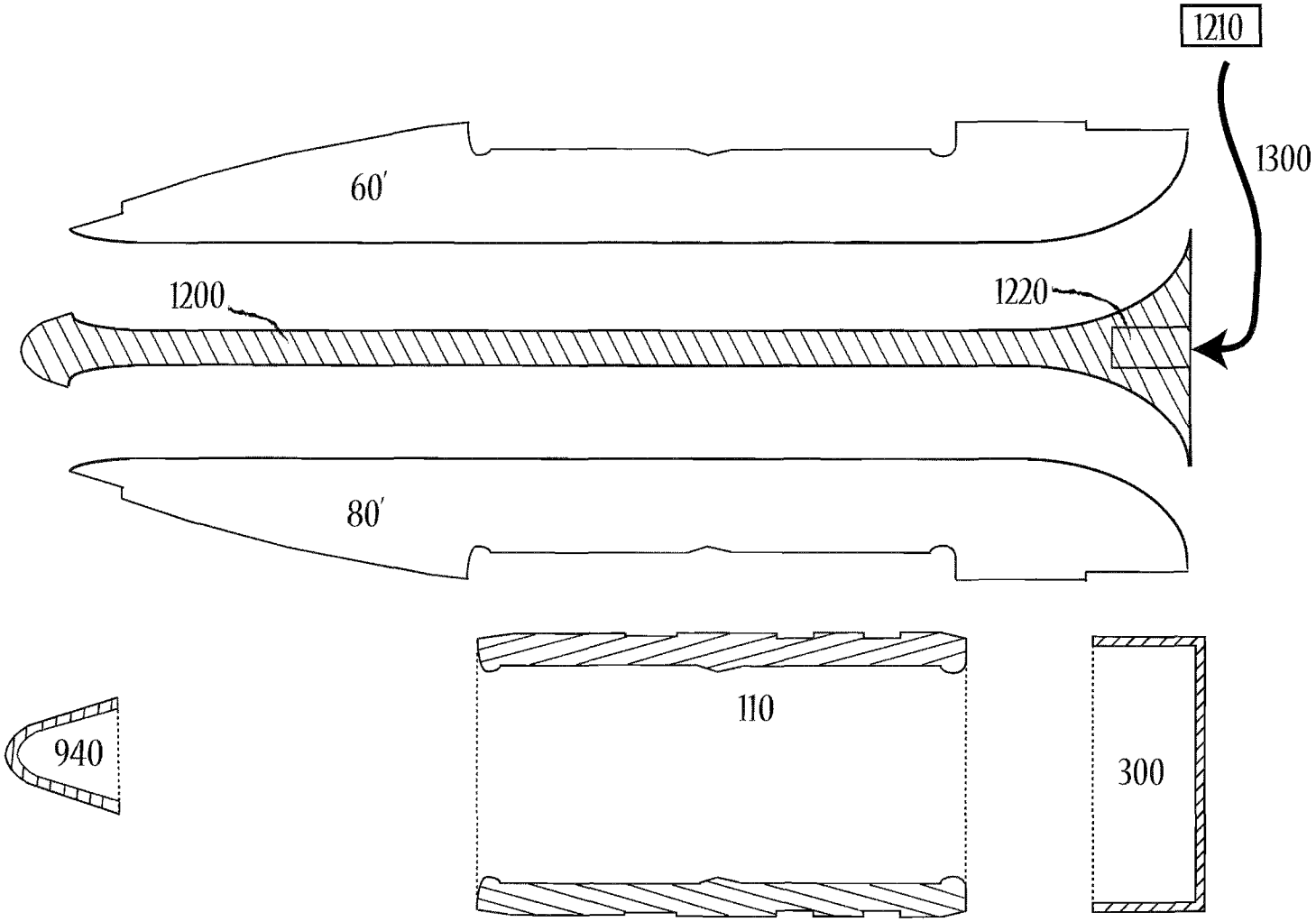
FIG. 13 shows an exploded view of the eighth alternative embodiment cross-section shown in FIG. 12, along with the method of how the supplemental payload is inserted into the rear of this central post section.

FIG. 13 shows an exploded view of the eighth alternative embodiment cross-section components shown in FIG. 12, including three binding elements or partial jackets, one at the tip 940, mid-section 110, and rear of the bullet 300, and three bullet body longitudinal sections, side longitudinal sections 60' and 80' and a central post section 1200. Also shown is supplemental payload 1210 along with the directional arrow 1300 showing the method of inserting this payload into cavity 1220 at the rear of central post section 1200.

Figure 14:
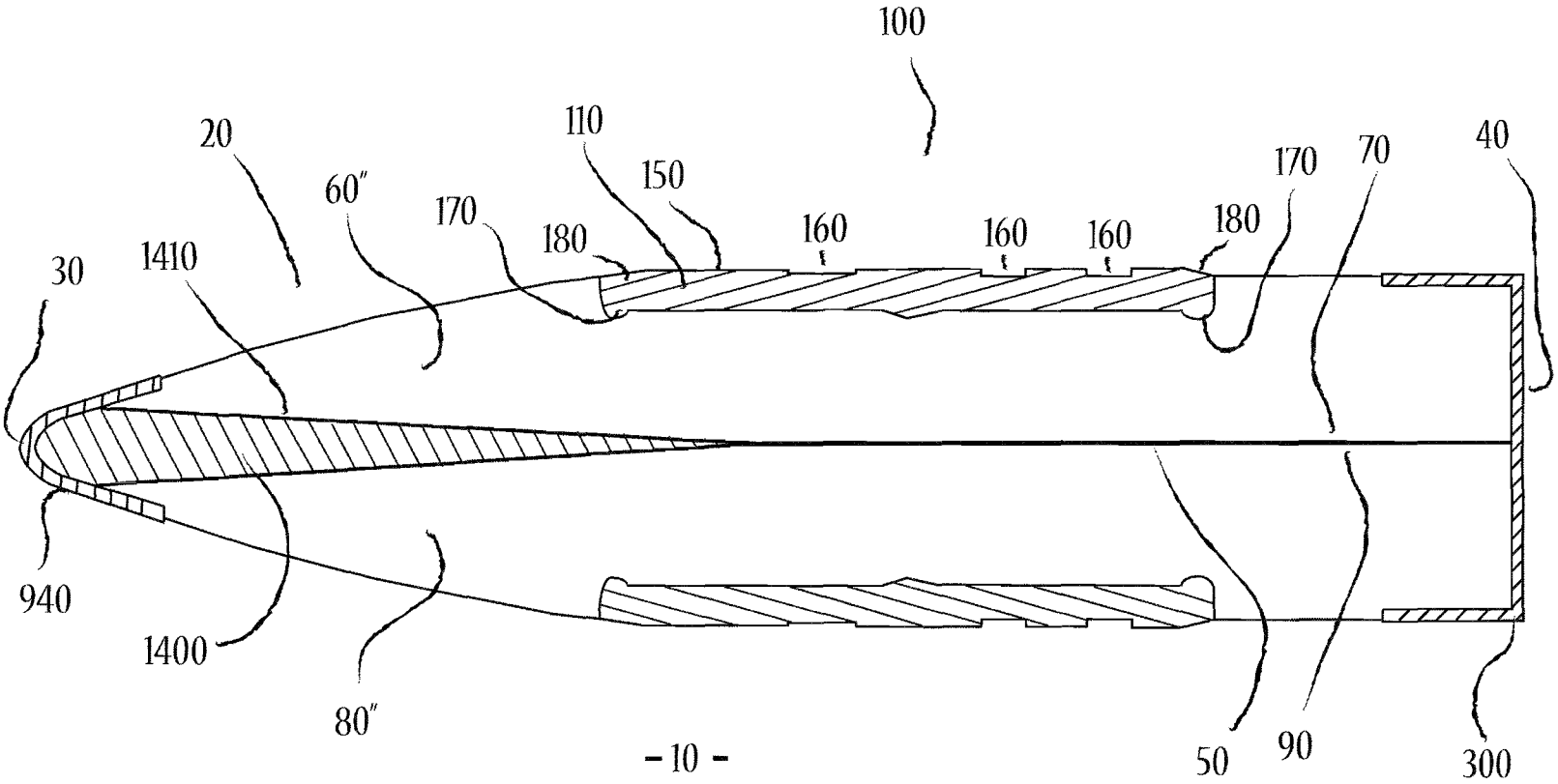
FIG. 14 shows a ninth alternative embodiment of a longitudinally sectioned bullet, shown as a longitudinal cross-section, and containing two side longitudinal sections and a central wedge section designed to help further separate the longitudinal sections upon impact. Also shown are three binding elements or partial jackets, one at the tip, mid-section, and rear of the bullet.

FIG. 14 shows a ninth alternative embodiment of a longitudinally sectioned bullet, shown as a longitudinal cross-section, and containing a central wedge section 1400 designed to help further separate the longitudinal sections 60" and 80" upon impact. The central wedge section 1400 can itself be rigid, semi-rigid, or frangible upon impact. Furthermore, central wedge section 1400 is adapted to contain or comprise at least one supplemental payload. As such, central wedge section 1400 is adapted to be embedded with at least one chemical composition chosen from the class of chemical compositions including explosive materials, tracer elements, electronic circuits and transmitters. This ninth alternative embodiment also includes three binding elements or partial jackets, one at the tip 940, mid-section 110, and rear of the bullet 300. Upon impact and penetration into a target, at least one binding elements or partial jackets rupture, such as binding element 940 at the bullet tip. The force of impact slows the central wedge 1400 while side longitudinal sections 60" and 80" move ahead of this wedge, along its sloped exterior surface 1410, which helps separate longitudinal sections 60" and 80" as bullet body components continue to penetrate the target. The central wedge becomes deposited inside the target to affect the target.

Figure 15:
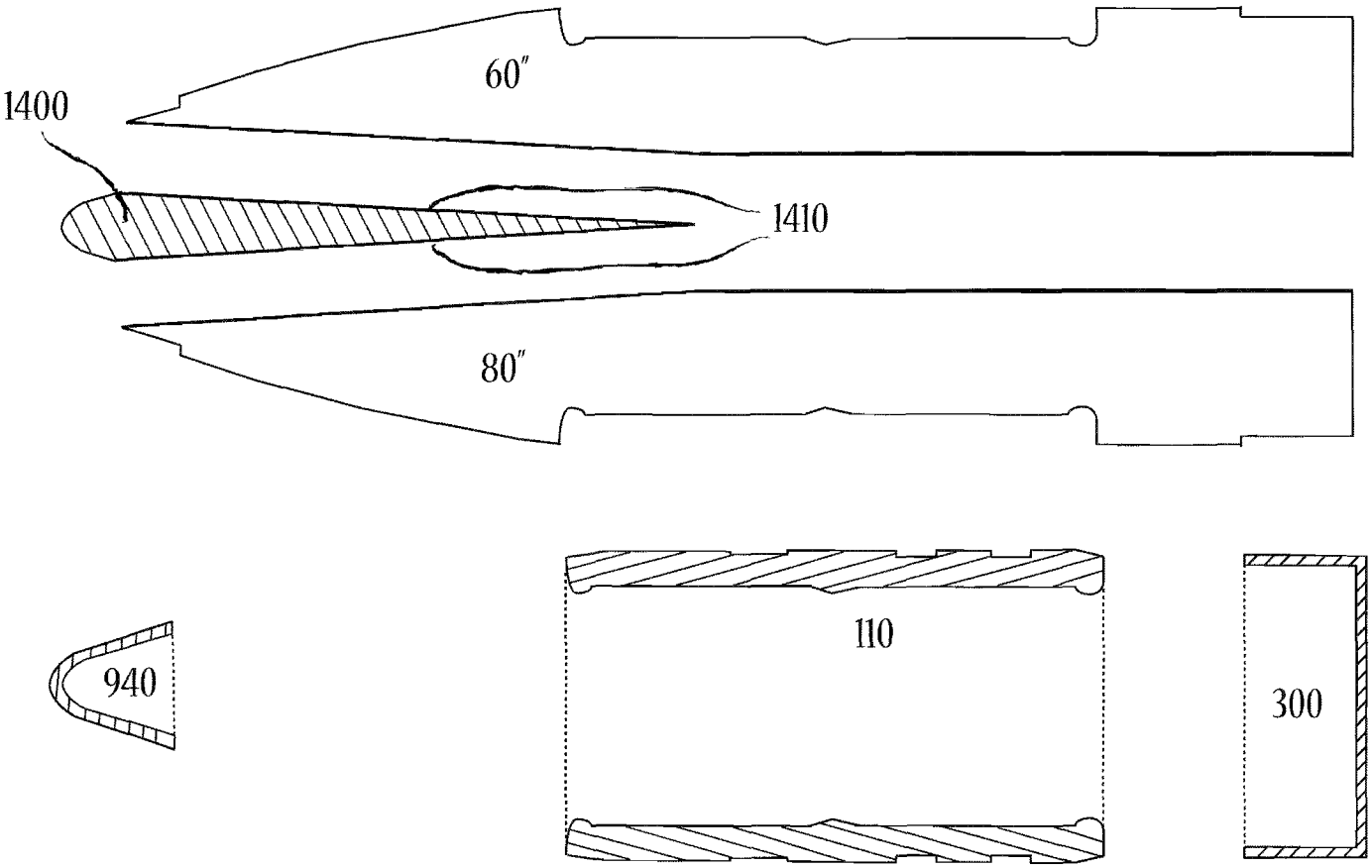
FIG. 15 shows an exploded view of the ninth alternative embodiment cross-section shown in FIG. 14.

FIG. 15 shows an exploded view of the ninth alternative embodiment cross-section shown in FIG. 14. Shown are the three binding elements or partial jackets, one at the tip 940, mid-section 110, and rear of the bullet 300, and three bullet body longitudinal sections, side longitudinal sections 60" and 80" and a central wedge section 1400, and its sloped outer surface 1410.

Figure 16:
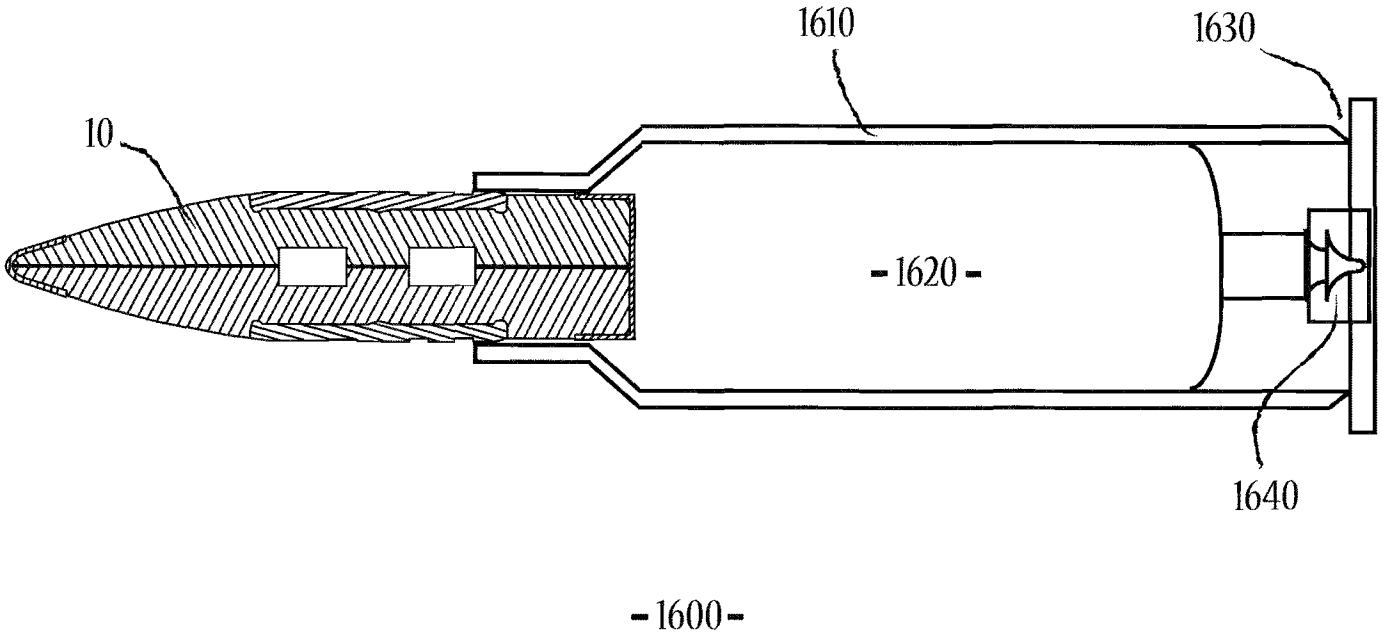
FIG. 16 shows the cross-section of a cartridge containing a projectile described by this invention. The projectile in FIG. 16 resembles the seventh bullet embodiment, but any of the embodiments can be associated with such cartridge. The cartridge also includes the case/shell, gun powder or cordite, and a primer.

FIG. 16 shows the cross-section of a cartridge 1600 containing projectile 10 of the present invention. The cartridge also generally consists of case or shell 1610; along with the propellant chamber 1620, which is adapted to contain gunpowder or cordite, not shown; part of the casing used for loading 1630; and the primer 1640, which ignites the propellant. This ammunition is adapted to additionally be crimped. Additionally, a circumferential groove of generally corrugated appearance (circumferentially running cannelure), is adapted to optionally be cut or impressed into a bullet and/or cartridge case, such as to help hold the bullet in its case, or in automatic loading or reloading, or such as is used when a roll crimp is applied to the bullet. Such an added groove is adapted to also help remove empty cases of fired ammunition, and is adapted to be called an extractor groove. Such optional embodiments are obvious to those skilled in the art, and may not be shown in some figures.

Figure 17:
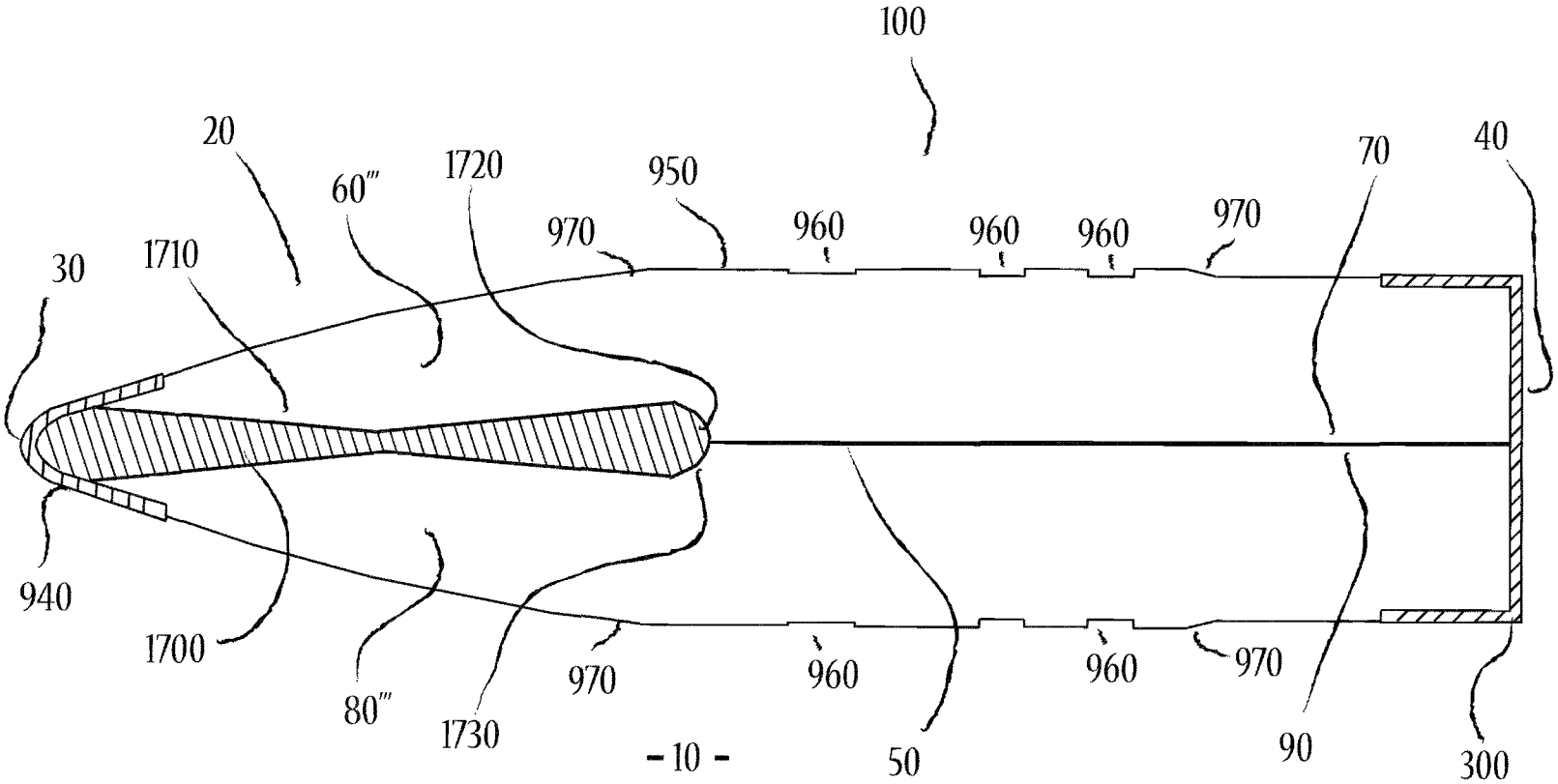
FIG. 17 shows a tenth alternative embodiment of a longitudinally sectioned bullet, shown as a longitudinal cross-section, and containing at least two side longitudinal sections and a central hourglass-shaped section designed to begin to rupture the binding element or partial jacket at the tip of the bullet upon impact and further separate the longitudinal sections following impact and penetration of the bullet. Also shown are the binding elements or partial jackets, one at the tip of the bullet, and one at the rear of the bullet, but none at the mid-section of the bullet.

FIG. 17 shows a tenth alternative embodiment of a longitudinally sectioned bullet, shown as a longitudinal cross-section, and preferably comprising at least one additional penetrable individual body section, central hourglass-shaped section 1700 (also having an at least partial wedge-shape), designed to begin to rupture the binding element or partial jacket 940 at the tip of the bullet upon impact and further separate the at least two longitudinal sections 60''' and 80''' following impact and penetration of the bullet. The longitudinal sections 60''' and 80''' are non-fused, meaning non-soldered, non-glued, non-bonded and non-joined, separate penetrable individual solid metal longitudinal body sections of the projectile; these longitudinal body sections are not bonded to each other nor have a binder between them, but are merely held adjacently in place by the binding elements or partial jackets 300 and 940, one at/near the tip or frontal region of the bullet 940, and one at the rear of the bullet 300. The central hourglass-shaped section 1700 is also ideally a non-fused and non-soldered and non-glued, separate penetrable individual solid body section, which is primarily held in place by binding element or partial jacket 940 at the tip 30 and between longitudinal sections 60''' and 80''' along its sides 1710, and by a curved abutment 1730 of longitudinal sections 60''' and 80''' at its rounded rear 1720. The central hourglass-shaped section 1700 is ideally hard and solid. The central hourglass-shaped section 1700 is ideally a hard, non-fused penetrable individual solid metal body section centered around a central longitudinal axis 50.

The at least two penetrable individual longitudinal body sections each have at least one width, such as near central region 100, approximately equal to a cross sectional radius of said penetrable projectile when assembled. The at least two penetrable individual longitudinal body sections also each have at least one width, such as near tip region 30, approximately less than a cross sectional radius of said penetrable projectile when assembled. The at least two longitudinal body sections 60''' and 80''' are symmetrical with respect to each other and represent at least partial radial sections of the assembled projectile. When assembled, the penetrable projectile 10 has an exterior surface having a circular cross sectional configuration and at least one longitudinal axis, including a central longitudinal axis 50. The penetrable projectile 10 appears with a plurality of full and or partial axial cuts extending along some length of the penetrable projectile from/near the at least one longitudinal axis of the penetrable projectile to the exterior surface, thereby dividing the penetrable projectile into a plurality of similarly configured sections, penetrable individual longitudinal body sections. The penetrable projectile is therefore at least radially sectioned and longitudinally sectioned lengthwise along a longitudinal length by being divided by at least one plane in a tip-to-rear/front-to-back direction of the penetrable projectile. Radially sectioned means sectioned along at least a portion of a radial line emanating perpendicularly from a central longitudinal axis of the projectile.

Upon impact and penetration into a target, at least one binding element or partial jacket ruptures, such as binding element 940 at the bullet tip by the central hourglass-shaped section 1700 pushing against it from the inside when the binding element 940 is slowed by the predetermined target's flesh. The force of impact and penetration also slows the central hourglass-shaped section 1700 while side longitudinal sections 60''' and 80''' try to move ahead of this section, along its sloped surface 1710. However, the curved abutment 1730 of the longitudinal sections 60''' and 80''' at least partially catches and are impacted with the rounded rear 1720 of the central hourglass-shaped section 1700, which is believed to send a shockwave-like, mechanical wave of force backwards through the longitudinal sections towards the projectile's rear 40, and forcibly pushing the longitudinal sections apart in an elastic collision (reminiscent of a cue ball striking billiard balls) and ensuring that the rear binding element or partial jacket 300 ruptures and that these longitudinal sections go off in separate trajectories with separate motions inside the target as penetration continues. This unique design distributes/redistributes kinetic energy differently among the projectile body sections in this tenth alternative embodiment than in the ninth alternative embodiment and other embodiments. It is believed that the kinetic energy distribution/redistribution of the tenth embodiment causes massive damage to the human target while reducing the chance of one or more body sections exiting the target and hurting someone else. The unique shape of the central hourglass-shaped section greatly separates the longitudinal sections 60''' and 80''' inside the target, while depositing the central hourglass-shaped section inside the target.

In some alternative embodiments, the central hourglass-shaped section 1700 can itself be rigid, semi-rigid, or frangible upon impact. Because the central hourglass-shaped section becomes deposited inside the target, in some alternative embodiments it is adapted to contain or be associated with at least one supplemental payload. A supplemental payload can be an at least one reactive chemical substance or explosive material not involved in the firing or propulsion of said projectile to a predetermined target, or some other supplemental payload.

In some alternative embodiments, at least partially interlocking prong-like elements are found along at least two penetrable individual body sections.

Figure 18:
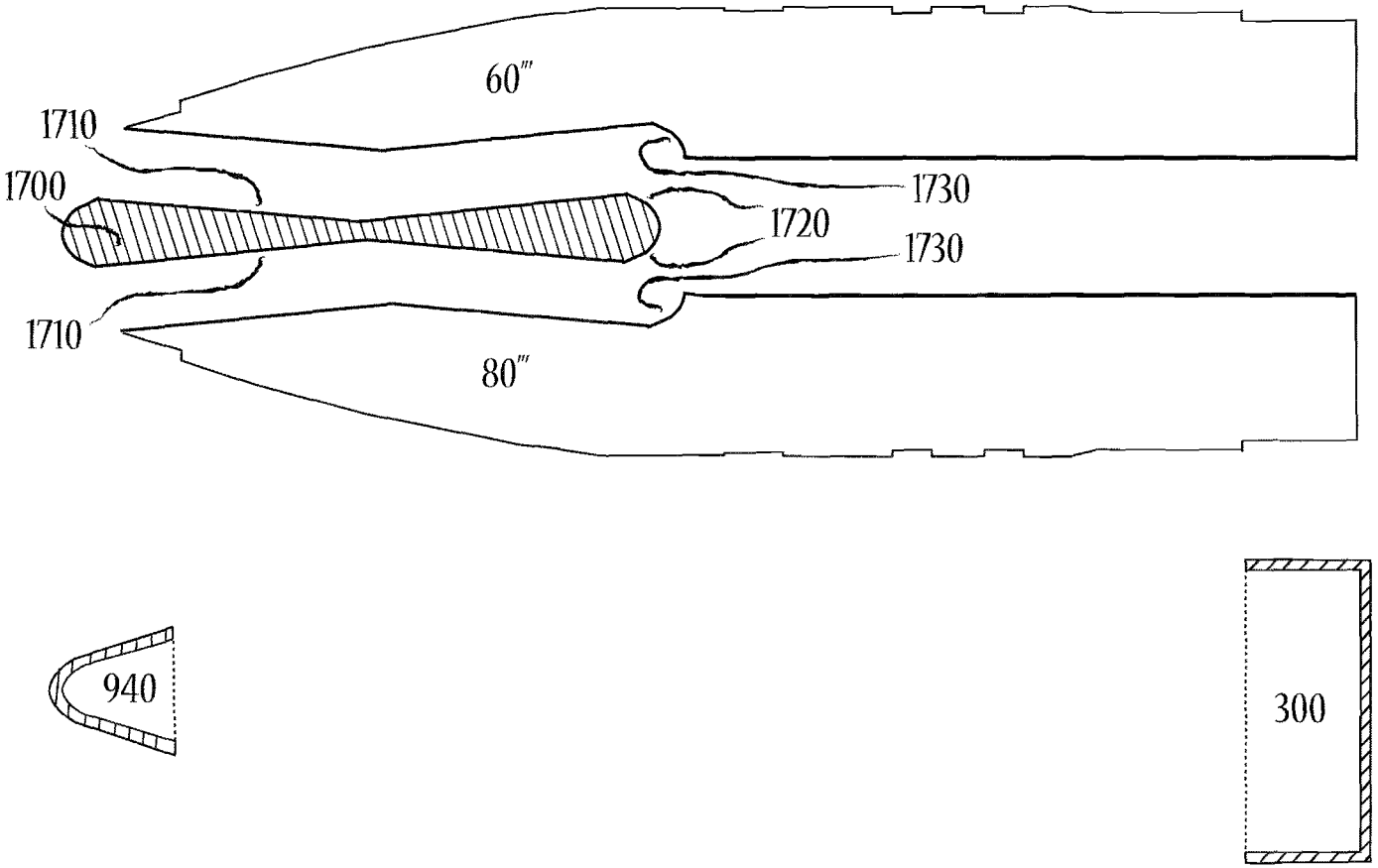
FIG. 18 shows an exploded view of the tenth alternative embodiment cross-section shown in FIG. 17.

FIG. 18 shows an exploded view of the tenth alternative embodiment cross-section shown in FIG. 17. Shown are two of the binding elements or partial jackets, one at the tip 940, one at the rear of the bullet 300, the at least two body longitudinal sections, side longitudinal sections 60''' and 80''', along with a central hourglass-shaped section 1700, and its sloped outer surface 1710 and rounded rear 1720. This figure also shows more detail to the rounded abutment 1730 of the longitudinal body sections.

Figure 19:
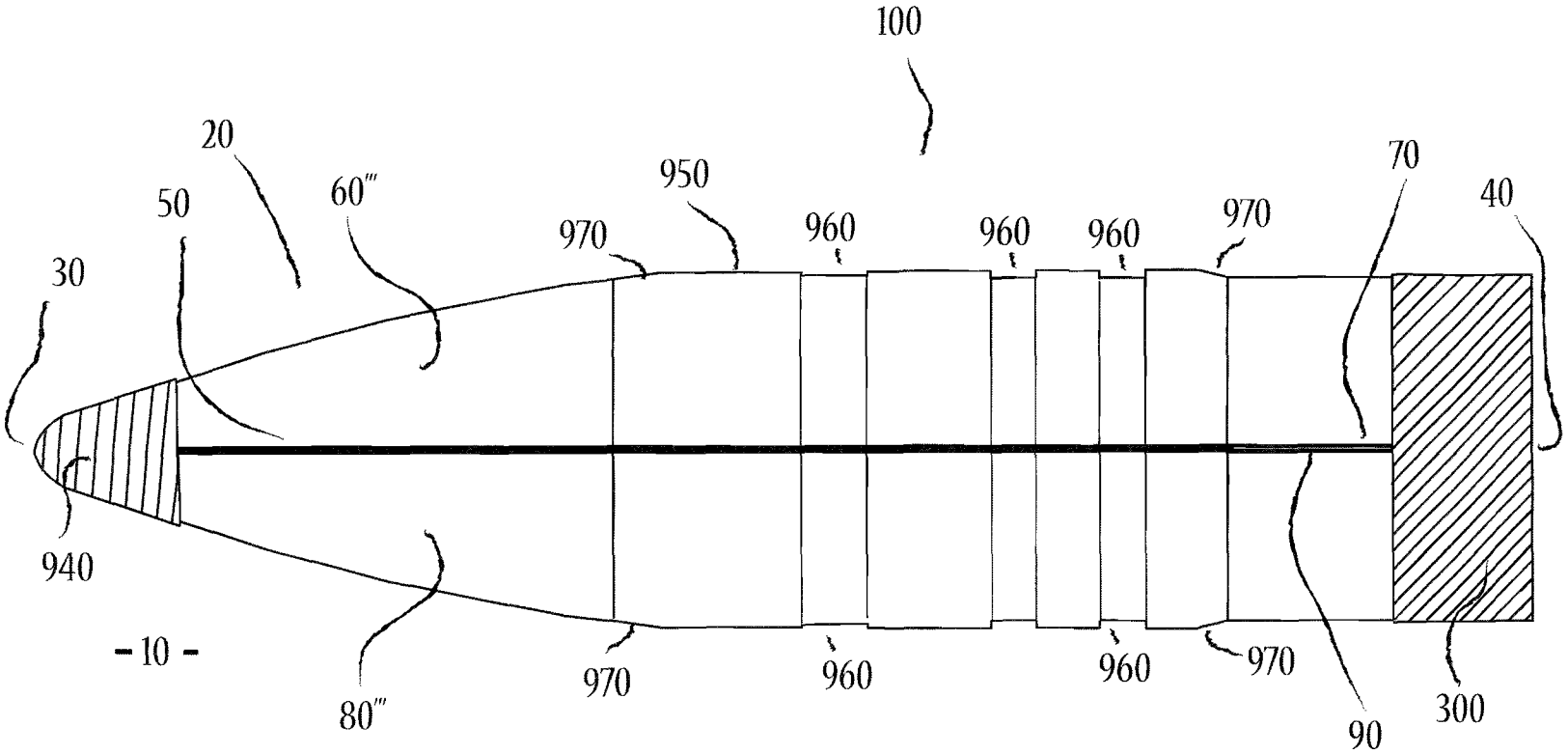
FIG. 19 shows a side perspective of the tenth bullet embodiment described by FIG. 17.

FIG. 19 shows a side perspective of the tenth bullet embodiment described by FIG. 17. This FIG. 19 shows the exterior binding element or partial jacket 940 as a conical tip of the bullet body 20, and shows exterior binding element or partial jacket 300 as a cup or cap on the rear end of the bullet body. This figure also shows more detail to the preferable central 100 exterior surface 950 of the bullet body 20 of longitudinal sections 60''' and 80''' which has annular grooves 960, which are adapted to engage the rifling of the firearm, as well as, tapered slopes 970, to facilitate or aid in the aerodynamic configuration of the entire projectile 10 thereby facilitating the flight of the projectile 10 after it leaves the barrel of the firearm.

Figure 20:
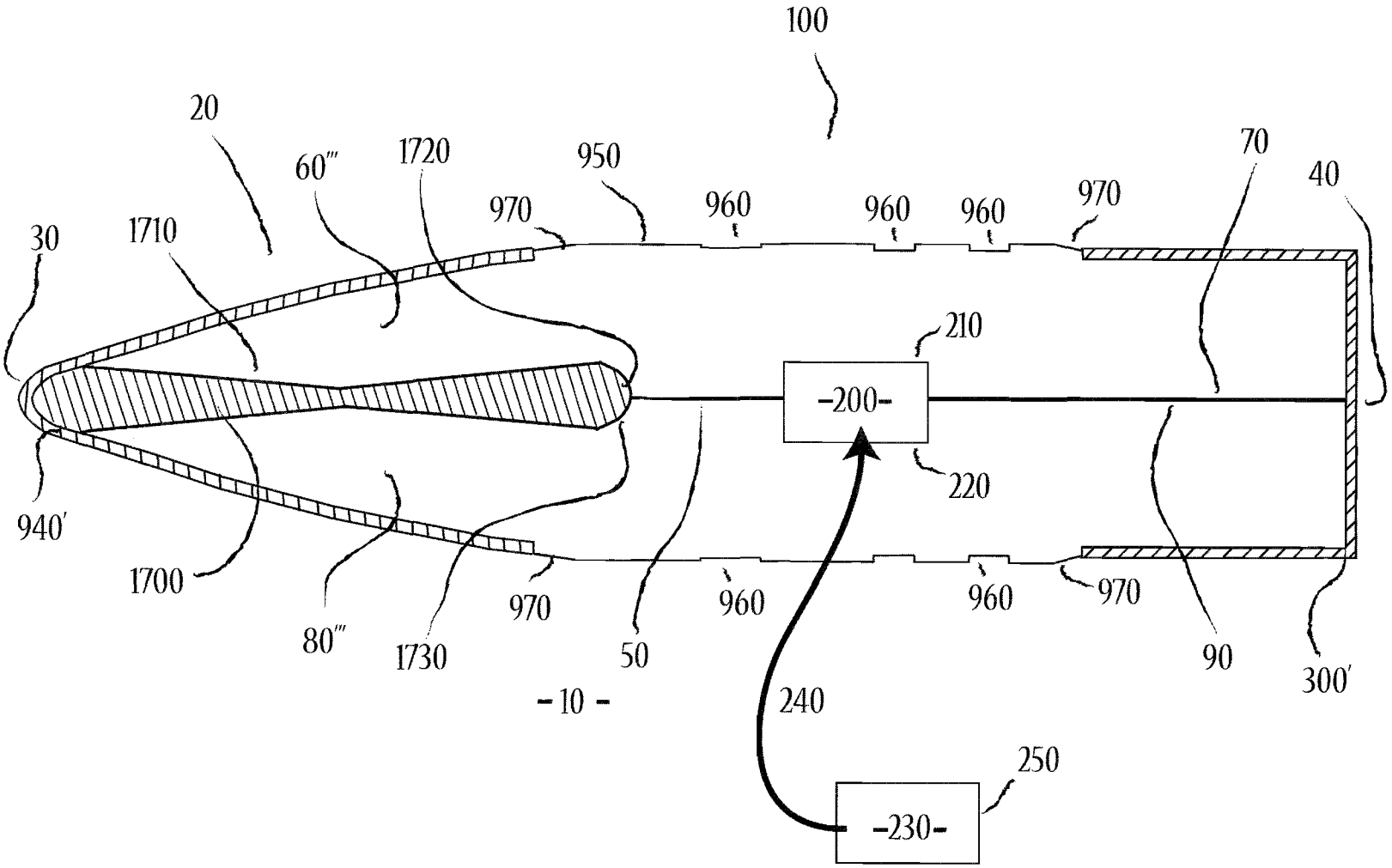
FIG. 20 shows a cross-section of an alternative tenth bullet embodiment, similar to that of FIG. 17, but with an associated optional supplemental payload formed into the longitudinal sections or contained in a central cavity shared by both longitudinal sections. The binding elements or partial jackets of this alternative tenth bullet embodiment, one at the tip of the bullet, and one at the rear of the bullet, are extended in longitudinal length compared to the previously shown binding elements.

FIG. 20 shows a cross-section of an alternative to the tenth bullet embodiment, similar to that of FIG. 17, but with an associated optional supplemental payload 230 formed into the longitudinal sections or contained in a central cavity 200 shared by both longitudinal sections. The unique design of the central hourglass-shaped section ensures that any optional supplemental payload 230; chemical, explosive, reactive material, electronic, or otherwise; is efficiently deposited inside the human target. The binding elements or partial jackets of this alternative tenth bullet embodiment 300' and 940', one at the tip of the bullet 940', and one at the rear of the bullet 300', are extended in longitudinal length compared to the previously shown binding elements. This allows the longer binding elements to have delayed rupturing so that the projectile penetrates deeper inside the target before longitudinal sections separate away from each other, and or also to support more higher powered cartridges.

Figure 22:
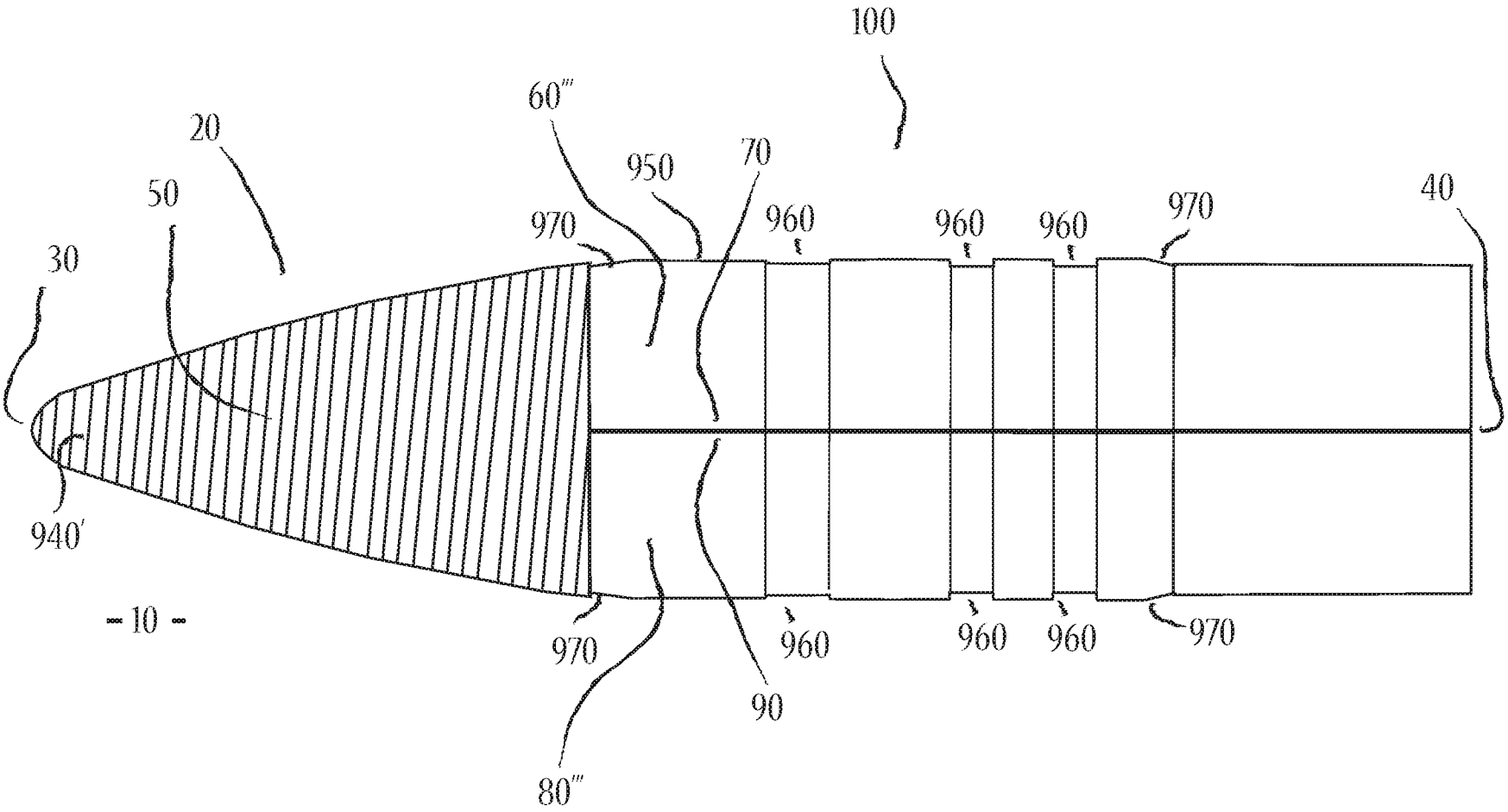
FIG. 22 shows a side perspective of an alternative to any of the above embodiments, such as the tenth alternative embodiment, having only a single exterior binding element; a single exterior binding element emanating at or extending from the projectile tip.

Alternatively to any of the above embodiments, these exterior binding elements can extend across the entire projectile and or be as one fully encompassing exterior binding element or rupturable jacket (not shown). Alternatively to any of the above embodiments, only a single exterior binding element can emanate from the projectile tip and extend towards the rear of the projectile, thereby covering a portion of the projectile, such as up to half of the projectile, or more than half of the projectile, or even nearly all or all of the projectile, without a second exterior binding element (e.g., FIG. 22). The at least two penetrable individual longitudinal body sections separate away from each other inside of said predetermined target and deliver said at least one supplemental payload to within said predetermined target, which can cause further damage inside of said predetermined target in addition to damage caused by said at least two penetrable individual longitudinal body sections.

Figure 21:
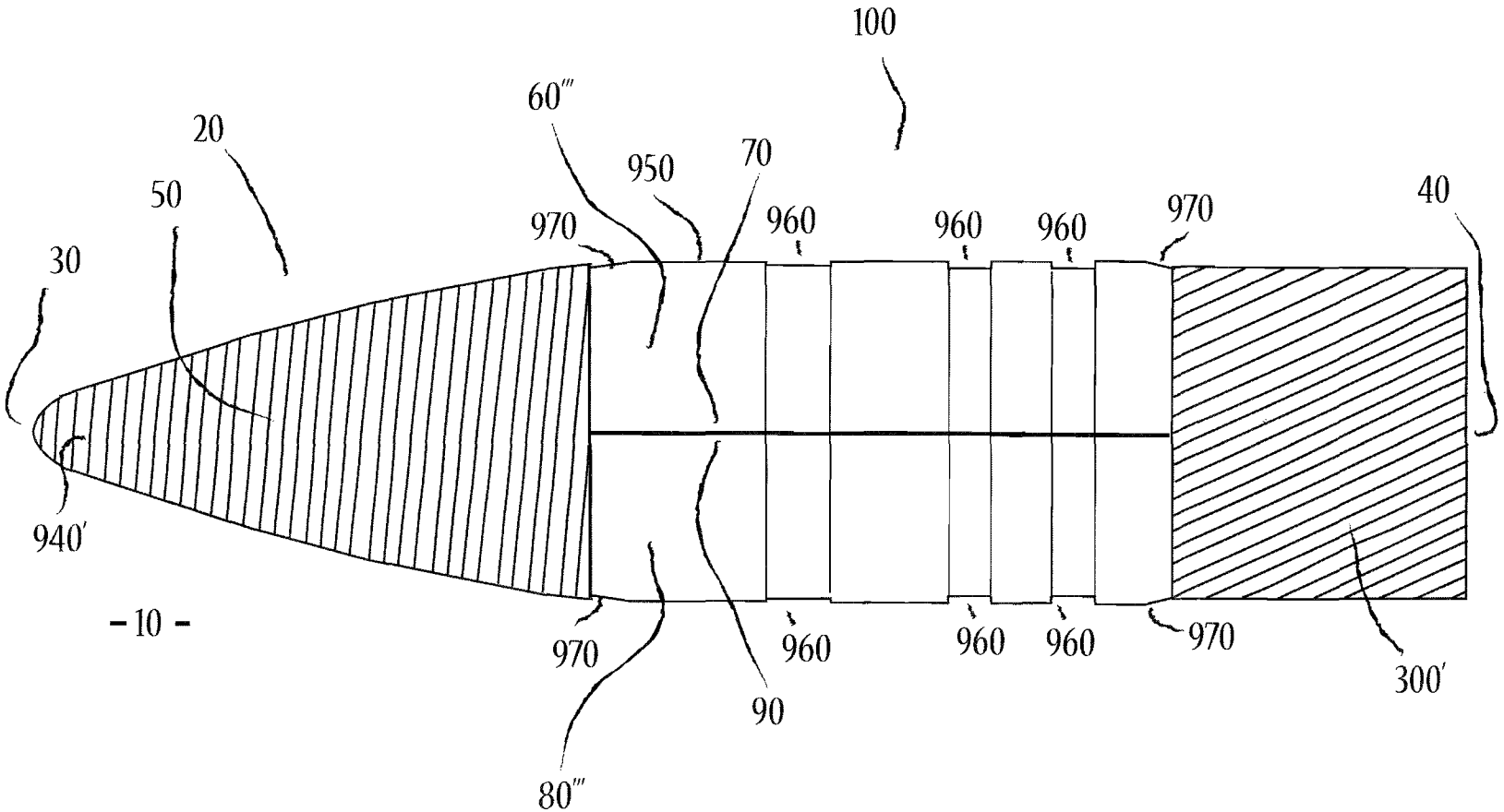
FIG. 21 shows a side perspective of the alternative tenth bullet embodiment described by FIG. 20.

FIG. 21 shows a side perspective of the alternative to the tenth bullet embodiment described by FIG. 20. This FIG. 21 shows the long binding element or partial jacket 940' as a conical tip of the bullet body 20, and shows the long binding element or partial jacket 300' as a cup or cap on the rear end of the bullet body.

The present invention includes at least one exterior binding element and or partial bullet jacket, at least at the tip of the penetrable projectile, so that the projectile fully penetrates a predetermined target before the penetrable individual longitudinal body sections fully separate away from each other, unlike previous projectiles missing a frontal exterior element or hard tip.

The invention is a penetrable projectile structured to be discharged from a firearm, said penetrable projectile is comprised of at least two penetrable individual longitudinal body sections, said penetrable projectile is further comprised of at least one binding element that holds the at least two penetrable individual longitudinal body sections together at least before impact with a predetermined target. The at least one binding element includes at least one exterior binding element.

At least one exterior binding element is adapted to be an at least partial bullet jacket.

At least one exterior binding element is made/structured to rupture upon striking a predetermined target.

The at least two penetrable individual longitudinal body sections are adapted to be symmetrical.

The at least two penetrable individual longitudinal body sections are adapted to be nonsymmetrical to each other and or to at least one additional penetrable individual body section.

The penetrable projectile is adapted to be comprised of symmetrical and nonsymmetrical penetrable individual body sections.

The penetrable projectile is adapted to be comprised of symmetrical and nonsymmetrical penetrable individual longitudinal body sections.

The penetrable projectile is adapted to be at least partially sectioned from a central/primary longitudinal axis.

The penetrable projectile is adapted to be at least partially sectioned from a non-central longitudinal axis.

The penetrable projectile is adapted to be at least partially sectioned from at least one additional longitudinal axis.

The penetrable projectile is adapted to have at least one penetrable individual longitudinal body section having a surface interior to the projectile that is at least partially tilted/skewed from a longitudinal axis.

The penetrable projectile is adapted to be at least partially sectioned from a tilted/skewed axis.

At least one penetrable individual longitudinal body section is adapted to span the full length of the penetrable projectile.

At least one penetrable individual longitudinal body section is adapted to not span the full length of the penetrable projectile.

Penetrable individual longitudinal body sections are adapted to span the full width of the penetrable projectile when assembled.

Penetrable individual longitudinal body sections are adapted to not span the full width of the penetrable projectile, at least in some regions, when assembled.

The at least one exterior binding element is chosen from binding elements, including, but not limited to, frontal binding elements, mid-section binding elements, and rear binding elements.

An at least one additional exterior binding element is chosen from binding elements including frontal binding elements, midsection binding elements, and rear binding elements.

The penetrable projectile is adapted to have at least one at least partial bullet jacket chosen from bullet jacket sections, including, but not limited to, frontal jacket sections, middle jacket sections, and rear jacket sections.

The penetrable projectile is adapted to have a full bullet jacket, such as a rupturable full bullet jacket.

The penetrable projectile is adapted to have no bullet jacket.

The penetrable projectile is adapted to have a mid-section further having at least one annular groove/irregular surface feature integrally formed in its exterior surface.

Alternatively, an at least one exterior binding element, such as, but not limited to, a mid-section binding element, is adapted to have at least one annular groove/irregular surface feature integrally formed in its exterior surface.

An at least one middle exterior area is adapted to have at least one taper/tapered configuration, such as to enhance aerodynamics/aerodynamic flight of the penetrable projectile, such as by facilitating isolation/reducing area of contact of at least some of at least one penetrable individual longitudinal body section from contact with an internal surface of the firearm barrel.

Alternatively, an at least one exterior binding element, such as, but not limited to, a mid-section binding element, is adapted to have at least one taper/tapered configuration, such as to enhance aerodynamics/aerodynamic flight of the penetrable projectile, such as by facilitating isolation/reducing area of contact of at least some of at least one penetrable individual longitudinal body section from contact with an internal surface of the firearm barrel.

An at least one exterior binding element, such as, but not limited to, a mid-section binding element, is adapted to have at least one taper/tapered configuration, such as to at least partially enclose and facilitate gripping engagement of the exterior binding element with the penetrable individual longitudinal body sections.

An at least one exterior binding element, such as, but not limited to, a mid-section binding element, is adapted to have at least one inwardly directed, somewhat interior peripheral rim to provide a secure connection/attachment between the exterior binding element and at least one penetrable individual longitudinal body section.

The at least one exterior binding element is chosen from the class of binding elements including, but not limited to, annular shoulders, conical-shaped binding elements, ogive-shaped binding elements, tubular-shaped binding elements, and cup-shaped binding elements.

At least one penetrable individual longitudinal body section is adapted to be formed from at least one material selected from the groups of materials including, but not limited to, metals, aluminum, antimony, beryllium, bismuth, boron carbide, brass, bronze, chromium, cobalt, copper, gold, iridium, iron, lead, magnesium, mercury, molybdenum, nickel, palladium, platinum, rhodium, silicon carbide, silver, steel, tantalum, tellurium, tin, titanium, tungsten, tungsten carbide, depleted uranium, zinc, zirconium, metal alloys, carbon-fiber, polymers, polymer-metal composites, thermoplastic and metal powders, and any combinations thereof.

At least one exterior binding element is adapted to be formed from at least one material selected from the groups of materials including, but not limited to, metals, aluminum, bronze, brass, chromium, copper, epoxy, fiberglass, Kevlar, gold, graphite, iron, lead, magnesium, mercury, molybdenum, nickel, nylon, palladium, polycarbonate, polyester, polyethylene, polystyrene, polyamide, poly vinyl chloride, polyurethane, phenolic, thermoplastic polymer, thermoset polymer, rhodium, rubber, silicon, silver, steel, tantalum, tellurium, tin, titanium, Teflon, Torlon, Ultem, zinc, zirconium, metal alloys, carbon-fiber, polymers, polymer-metal composites, thermoplastic and metal powders, and any combinations thereof.

The penetrable projectile is adapted to be at least nearly lead-free or lead-free to be environmentally friendly.

An at least one exterior binding element is adapted to be formed from at least one material selected from the group of materials including, but not limited to, hard materials, soft materials, rigid materials, semi-rigid materials, pliable materials, frangible materials, non-frangible materials, and any combinations thereof.

At least one of said at least two penetrable individual longitudinal body sections is adapted to be removably connected to and separable from said exterior binding element/partial jacket upon said body striking and penetrating a predetermined target.

At least each of said at least two penetrable individual longitudinal body sections is adapted to be removably connected to and separable from said binding element/partial jacket upon said body striking and penetrating a predetermined target.

The exterior binding element is adapted to comprise an at least partially hollow interior dimensioned and configured to receive at least one of said at least two penetrable individual longitudinal body sections therein through an at least partially open ended construction of the exterior binding element.

The penetrable projectile is adapted to further include at least one additional penetrable individual body section.

The penetrable projectile is adapted to further include at least one additional penetrable individual longitudinal body section.

The penetrable projectile is adapted to further include at least one additional bullet body section other than a longitudinal body section.

The penetrable projectile is adapted to further include at least one additional bullet body section that spans at least most of the width of the penetrable projectile, and is adapted to consist of a latitudinal bullet body section.

The penetrable projectile is adapted to further include at least one additional bullet body section that spans at least most of the length of the penetrable projectile, and is adapted to consist of a central longitudinal bullet body section.

The penetrable projectile is adapted to further include at least one additional bullet body section that spans at least some of the length of the penetrable projectile, and is adapted to consist of a central longitudinal bullet body section.

The penetrable projectile is adapted to further include at least one additional bullet body section that spans at least most of the length of the penetrable projectile, and is adapted to consist of a non-central longitudinal bullet body section.

The penetrable projectile is adapted to further include at least one additional bullet body section that spans at least some of the length of the penetrable projectile, and is adapted to consist of a non-central longitudinal bullet body section.

The penetrable projectile is adapted to further include at least one discharge reinforcing element that provides the penetrable projectile with structural reinforcement during firing from a firearm, such as to help prevent at least partial premature separation of penetrable individual longitudinal body sections.

At least two penetrable individual longitudinal body sections are adapted to include at least one set of at least partially interlocking prong-like elements along their internally facing surfaces to provide additional structural support to the penetrable projectile body to help hold penetrable individual longitudinal body sections together better and are adapted to allow deeper penetration before separation of penetrable individual longitudinal body sections.

At least two penetrable individual longitudinal body sections are adapted to include correspondingly positioned sides disposed in confronting engagement with one another on an interior of said exterior binding element.

At least two penetrable individual longitudinal body sections are adapted to include correspondingly positioned sides disposed a predetermined spaced distance from one another within said exterior binding element, said space is adapted to be selected from spaces including, but not limited to, spaces that are empty/hollow, spaces that contain at least some of at least one supplemental payload, spaces that contain at least some of at least one penetrable projectile body section, and spaces that contain at least some of a wedge shape and or hourglass-shape, and spaces that contain at least some of a bullet tip, and any combinations thereof.

At least one penetrable individual body section is adapted to be radially centered in relation to at least one longitudinal section.

The penetrable projectile is adapted to be radially sectioned.

At least two penetrable individual longitudinal body sections are adapted to be radial sections.

At least one penetrable individual projectile body section is adapted to be at least partially wedge-shaped and located at least somewhat between two penetrable individual longitudinal body sections so as to help further separate the at least two penetrable individual longitudinal body sections upon striking and or penetrating a predetermined target.

At least one penetrable individual projectile body section is adapted to be at least partially hourglass-shaped and located at least somewhat between two penetrable individual longitudinal body sections so as to help further separate the at least two penetrable individual longitudinal body sections upon striking and penetrating a predetermined target.

The penetrable projectile is adapted to further include at least one additional penetrable individual body section, said at least one additional penetrable individual body section is a center section/radially centered in relation to at least one penetrable individual longitudinal body section.

The penetrable projectile is adapted to further include at least one additional penetrable individual body section, said at least one additional penetrable individual body section is at least partially wedge-shaped and or at least partially hourglass-shaped and located at least somewhat between said at least two penetrable individual longitudinal body sections so as to help further separate the at least two penetrable individual longitudinal body sections after striking a predetermined target.

The penetrable projectile is adapted to further include at least one additional penetrable individual body section, said at least one additional penetrable individual body section is at least partially wedge-shaped and or at least partially hourglass-shaped and located at least somewhat between said at least two penetrable individual longitudinal body sections including at/near the front/tip of said penetrable projectile so as to help rupture said exterior binding element at the tip of said penetrable projectile after striking a predetermined target and to help further separate the at least two penetrable individual longitudinal body sections while penetrating a predetermined target, and influencing kinetic energy redistribution and or separate trajectories among penetrable individual body sections of said penetrable projectile inside said predetermined target, and optionally reducing target exiting potential of the penetrable individual body sections.

At least two exterior binding elements are adapted to be at least partially connected to each other, or are conjoined or formed as one exterior binding element.

The penetrable projectile is adapted to be optionally further associated with at least one supplemental payload and is structured to deliver said at least one supplemental payload to/within a predetermined target.

The penetrable projectile is adapted to further include at least one additional penetrable individual body section optionally further associated with or containing at least one supplemental payload and is structured to deliver said at least one supplemental payload to/within a predetermined target.

At least one of said at least two penetrable individual longitudinal body sections is adapted to be structured to receive at least one supplemental payload at least partially on an interior thereof, such as, but not limited to, an interior recess/cavity of the penetrable individual longitudinal body section, such as to expose and deposit said at least one supplemental payload within a predetermined target.

The penetrable projectile is adapted to be further associated with at least one supplemental payload and is adapted to be structured to deliver said at least one supplemental payload to/within a target, said at least one supplemental payload is adapted to be selected from payloads, including, but not limited to, at least one chemical substance, at least one chemical composition, at least one dye, at least one isotope, at least one electronic circuit, at least one RFID tag, at least one tracer element, at least one transmitter, at least one tracking transmitter, at least one power source, such as a battery, at least one explosive material, at least one remote detonator, at least one SPLAT, Sticky Polymer Lethal Agent Tag, at least one Smartdust, at least one reactive material, or any combination thereof.

The penetrable projectile is adapted to further be associated with at least two supplemental payloads and is adapted to be structured to deliver said at least two supplemental payloads to/within a target, said at least two supplemental payloads is adapted to further have a synergistic combination/effect.

At least one exterior binding element can maintain said at least two penetrable individual longitudinal body sections in synchronized rotation; said at least one exterior binding element and said at least two penetrable individual longitudinal body sections concurrently rotate with one another in a common direction and synchronized manner as the projectile travels through and beyond a barrel of the firearm, such as during flight.

The penetrable projectile can fragment into at least two pieces upon impact in soft tissue.

The penetrable projectile is capable of at least one improved performance characteristic selected from measures of improved projectile performance, including, but not limited to, increased terminal effects, improved penetration, improved ballistic coefficients, improved accuracy, flatter trajectory, synchronous spin, gyro stability, yaw independence, extended range, extended range with improved accuracy, and any combinations thereof.

The penetrable projectile is adapted to have an exterior surface area of reduced contact with an internal surface of the firearm barrel, so as to improve at least some performance.

The penetrable projectile is adapted in some embodiments to also have at least some space between the exterior surface of at least one penetrable individual longitudinal body section and the interior surface of at least one exterior binding element that at least partially sheaths said penetrable individual longitudinal body section, such that said at least one exterior binding element is adapted to become at least partially deformed from the lands of the rifling of a firearm barrel to reduce friction and heat between the projectile and the interior of the barrel, while increasing the surface area of the binding element region that remains in contact with the spin-imparting lands of the barrel rifling; said such space is adapted to be designated as a crush zone, said crush zones is adapted to be preferably deformed in a radially inward direction by lands in a barrel in a predictable and consistent way when the projectile is fired, to maintain spin and kinetic energy imparted to the projectile.

The penetrable projectile is adapted to also be further associated with at least one barrel treatment chemical, chosen from barrel treatment chemicals including, but not limited to cleaning chemicals, lubricating chemicals, and conditioning chemicals, barrel treatment chemicals associated with at least one projectile component, barrel treatment chemicals impregnated into at least one projectile component, and barrel treatment chemicals impregnated in a thermoset polymer component of a projectile, such as, but not limited to, a exterior binding element, and any combinations thereof, to at least partially treat the barrel when said projectile is fired.

The invention can also be a projectile structured to be discharged from a firearm, said projectile comprising: a body comprising of at least two body sections with at least one surface interior to the bullet body that at least partially runs at least somewhat in the tip-to-rear/front-to-back direction of the projectile, said body further including at least one exterior binding/holding element disposed in at least partially surrounding/jacketing relation to said at least two body sections, said at least one exterior binding element structured to provide controlled rupturing of said exterior binding element responsive to said projectile striking a predetermined target, said exterior binding element disposed and dimensioned to define a reduced area of contact of said body with the rifling of the firearm, said at least one exterior binding element maintaining the at least two body sections in synchronized rotation while being fixedly secured to one another by said at least one exterior binding element whereby upon said projectile striking said predetermined target said at least one exterior binding element ruptures in an at least partially controlled fashion, thereby separating said at least two body sections of said projectile and delivering any supplemental payload contained therein.

The invention can include an ammunition cartridge including a projectile slideably disposed within said cartridge, said projectile comprised of at least two longitudinal body sections, said projectile further comprised of at least one exterior binding element that holds the at least two longitudinal body sections together at least before impact with a target.

The invention can also include an ammunition cartridge including a projectile slideably disposed within said cartridge, said projectile comprised of at least two longitudinal body sections, said projectile further comprised of at least one exterior binding element that holds the at least two longitudinal body sections together at least before impact with a target, said projectile further containing/associated with at least one supplemental payload, said ammunition cartridge structured to discharge the projectile from a firearm and capable of delivering said at least one supplemental payload to/within a predetermined target.

The invention is a penetrable projectile structured to be discharged from a firearm, said penetrable projectile being formed with an exterior surface having a circular cross sectional configuration and a central longitudinal axis, said penetrable projectile having a plurality of axial cuts extending along a length or some length of said penetrable projectile from/near the central longitudinal axis of said penetrable projectile to the exterior surface dividing said penetrable projectile into a plurality of similarly configured sections, penetrable individual longitudinal body sections, said penetrable projectile thereby being radially sectioned and longitudinally sectioned lengthwise along a longitudinal length by being divided by at least one plane in a tip-to-rear/front-to-back direction of said penetrable projectile, said penetrable projectile comprising at least two penetrable individual longitudinal body sections, said at least two penetrable individual longitudinal body sections being of identical size and shape, said at least two penetrable individual longitudinal body sections each having at least one width approximately equal to a cross sectional radius of said penetrable projectile when assembled, said penetrable projectile further comprising at least two exterior binding elements, including at the tip and at the rear of said penetrable projectile, that hold said at least two penetrable individual longitudinal body sections together at least until impact with said predetermined target, said at least two penetrable individual longitudinal body sections separating away from each other inside of said predetermined target and causing further damage inside of said predetermined target after said at least two exterior binding elements rupture.

The invention is also a penetrable projectile structured to be discharged from a firearm, said penetrable projectile comprising a longitudinally sectioned body of at least two body sections, said at least two body sections being at least partial radial sections of said penetrable projectile, each of said at least two body sections comprising at least one interior surface that runs in the tip-to-rear/front-to-back direction of said penetrable projectile, said penetrable projectile further comprising at least one binding/holding element, including at least at the frontal region of said penetrable projectile, and disposed in radially surrounding relation to said at least two body sections, said at least one binding/holding element structured to provide controlled rupturing of said at least one binding/holding element responsive to said penetrable projectile striking and penetrating a predetermined target, said at least one binding/holding element maintaining said at least two body sections in synchronized rotation while being fixedly secured to one another by said at least one binding/holding element whereby upon said penetrable projectile striking said predetermined target said at least one binding/holding element begins to rupture in an at least partially controlled fashion, after said at least one exterior binding element ruptures said at least two body sections of said penetrable projectile separating inside of said predetermined target and causing further damage inside of said predetermined target.

The invention is also a penetrable projectile structured to be discharged from a firearm, said penetrable projectile being formed with an exterior surface having a circular cross sectional configuration and at least one longitudinal axis, said penetrable projectile having a plurality of axial cuts extending along a length or some length of said penetrable projectile from said at least one longitudinal axis of said penetrable projectile to the exterior surface dividing said penetrable projectile into a plurality of similarly configured sections, penetrable individual longitudinal body sections, said penetrable projectile thereby being longitudinally sectioned lengthwise along a longitudinal length by being divided by at least one plane in a tip-to-rear/front-to-back direction of said penetrable projectile, said penetrable projectile comprising at least two penetrable individual longitudinal body sections, said at least two penetrable individual longitudinal body sections being of identical size and shape, said at least two penetrable individual longitudinal body sections each having at least one width approximately less than a cross sectional radius of said penetrable projectile when assembled, said penetrable projectile further comprising at least two exterior binding elements, including at the tip and at the rear of said penetrable projectile, that hold said at least two penetrable individual longitudinal body sections together at least until impact with said predetermined target, said at least two penetrable individual longitudinal body sections separating away from each other inside of said predetermined target and causing further damage inside of said predetermined target after said at least two exterior binding elements rupture.

The penetrable projectile optionally or preferably comprising at least one additional penetrable individual body section, said at least one additional penetrable individual body section being centered around a central longitudinal axis of said penetrable projectile, said at least one additional penetrable individual body section, chosen from body sections including, but not limited to, an at least partially wedge-shaped and or at least partially hourglass-shaped penetrable individual body section, helping to begin to rupture said exterior binding element at the tip of said penetrable projectile upon striking a predetermined target, said at least one additional penetrable individual body section helping to further separate said at least two penetrable individual longitudinal body sections after striking and penetrating a predetermined target and after said exterior binding element at the tip of said penetrable projectile ruptures.

Again or alternatively, the said at least one additional penetrable individual body section, chosen from body sections including, but not limited to, an at least partially wedge-shaped and or at least partially hourglass-shaped penetrable individual body section, helping to further separate said at least two penetrable individual longitudinal body sections after striking a predetermined target and after said exterior binding element at the tip of said penetrable projectile ruptures. The at least one additional penetrable individual body section also helping to rupture said exterior binding element at the tip of said penetrable projectile and change the kinetic energy distribution among projectile body sections upon impact and penetration when separating these body sections, and having potential to reduce the sections from exiting the target.

The invention is also an ammunition cartridge or cartridges comprising the projectile(s) stated above.

The invention is also an ammunition cartridge comprising a penetrable lethal projectile slideably disposed within said ammunition cartridge, said penetrable lethal projectile structured to be discharged from a firearm, said penetrable lethal projectile being radially sectioned and longitudinally sectioned lengthwise along a longitudinal length by being divided by at least one plane in a tip-to-rear/front-to-back direction of said penetrable lethal projectile, said penetrable lethal projectile comprising at least two non-fused penetrable individual solid metal longitudinal body sections, said penetrable lethal projectile further comprising at least one outer/exterior binding element, including at least at or near the tip of said penetrable lethal projectile, that holds said at least two non-fused penetrable individual solid metal longitudinal body sections together at least until impact with a target, said at least two non-fused penetrable individual solid metal longitudinal body sections further separating away from each other inside of said target and causing widespread damage inside of said target after said at least one exterior binding element ruptures.

The invention is also an ammunition cartridge is also an ammunition cartridge comprising a penetrable lethal projectile slideably disposed within said ammunition cartridge, said penetrable lethal projectile structured to be discharged from a firearm, said penetrable lethal projectile being formed with an exterior surface having a circular cross sectional configuration and at least one longitudinal axis, said penetrable lethal projectile having a plurality of axial cuts extending along a length or some length of said penetrable lethal projectile from said at least one longitudinal axis of said penetrable lethal projectile to the exterior surface dividing said penetrable lethal projectile into a plurality of similarly configured sections, non-fused penetrable individual solid metal longitudinal body sections, said penetrable lethal projectile thereby being longitudinally sectioned lengthwise along a longitudinal length by being divided by at least one plane in a tip-to-rear/front-to-back direction of said penetrable lethal projectile, said penetrable lethal projectile comprising at least two non-fused penetrable individual solid metal longitudinal body sections, said at least two non-fused penetrable individual solid metal longitudinal body sections being of identical size and shape, said at least two non-fused penetrable individual solid metal longitudinal body sections each having at least one width approximately less than a cross sectional radius of said penetrable lethal projectile when assembled, said penetrable lethal projectile further comprising at least one frontal exterior binding element, including at least at/near the tip/tip region or frontal region of said penetrable lethal projectile, that holds said at least two non-fused penetrable individual solid metal longitudinal body sections together at least until impact with said predetermined target, said at least two non-fused penetrable individual solid metal longitudinal body sections separating away from each other inside of said predetermined target and causing further damage inside of said predetermined target after said at least one frontal exterior binding element ruptures. The penetrable lethal projectile further optionally comprising at least one additional penetrable individual body section, said at least one additional penetrable individual body section being hard and preferably metallic and centered around a central longitudinal axis of said penetrable lethal projectile, said at least one additional penetrable individual body section helping to further separate said at least two non-fused penetrable individual solid metal longitudinal body sections after striking a predetermined target and after said frontal exterior binding element at the tip of said penetrable lethal projectile ruptures. The projectile may optionally comprise, deliver, and deposit a supplemental payload to the target.

It can be envisioned and understood that the present invention can include armor piercing embodiments and or bullet proof vest piercing embodiments.

Importantly, the present invention provides for longitudinally sectioned projectiles that are ideal for use as sniper rounds, such as are ideal for use by special forces and SWAT teams for special operations to take out a specific target.

Alternatively to any of the above embodiments, these exterior binding elements can extend across the entire projectile and or be as one fully encompassing exterior binding element or rupturable jacket. Alternatively to any of the above embodiments, only a single exterior binding element can emanate from the projectile tip and extend towards the rear of the projectile, thereby covering a portion of the projectile, such as up to half of the projectile, or more than half of the projectile, or even nearly all or all of the projectile, without a second exterior binding element (e.g., FIG. 22).

The invention also includes the method of manufacturing a projectile structured to be discharged from a firearm, said projectile comprised of at least two longitudinal body sections, said projectile further comprised of at least one binding element that holds the at least two longitudinal body sections together at least before impact with a predetermined target, and said projectile optionally containing at least one supplemental payload.

The invention also includes the method of manufacturing a projectile structured to be discharged from a firearm, said projectile comprised of at least two longitudinal body sections, said projectile further comprised of at least one binding element that holds the at least two longitudinal body sections together at least before impact with a predetermined target, and said projectile optionally containing at least one supplemental payload, whereby at least two longitudinal body sections are made from the same identical mold and or process, and are thus, identical and symmetrical bullet body components.

The invention also includes the method of manufacturing a cartridge comprising the projectile(s) described above.

The invention includes the method of using a firearm to fire at a predetermined target a projectile structured to be discharged from said firearm, said projectile comprised of at least two longitudinal body sections, said projectile further comprised of at least one binding element that holds the at least two longitudinal body sections together at least before impact with a predetermined target, said projectile optionally containing at least one supplemental payload.

The invention also includes the method of using a firearm to fire at a predetermined target a projectile structured to be discharged from said firearm. The method includes the steps as follows:

providing a projectile having at least two longitudinal body sections; and positioning at least one optional supplemental payload within said projectile; and holding together the at least two longitudinal body sections together at least before impact with the predetermined target; and impacting the projectile at the target to separate at least two longitudinal body sections; and releasing any payload within the target.

Importantly, the invention includes methods of firing/discharging a projectile from a firearm to deliver to/within a target an at least one supplemental payload to cause damage inside of the target additional to impact and penetration of the projectile. The at least one supplemental payload is released from a central/interior cavity and or an at least one additional penetrable individual body section of the projectile when an at least two longitudinal body sections of the projectile separate inside of the target. The at least one supplemental payload preferably comprises an at least one reactive chemical substance or explosive material not involved in the firing or propulsion of the projectile to the target. The at least one supplemental payload is preferably contained within a central/interior cavity of the projectile to protect the at least one supplemental payload from contact with/exposure to the projectile's exterior before reaching the target.

In a method as described above, the projectile is longitudinally sectioned lengthwise along its longitudinal length by being divided by at least one plane in a tip-to-rear/front-to-back direction of the projectile.

In a method as described above, the projectile comprises at least two penetrable longitudinal body sections.

In a method as described above, the projectile comprises at least two longitudinal body sections with at least one interior surface that runs in the tip-to-rear/front-to-back direction of the projectile.

In a method as described above, the projectile further comprises at least one exterior binding element at the tip and at the rear of the projectile.

In a method as described above, the projectile comprises at least one exterior binding element at the tip and at the rear of the projectile that holds the at least two longitudinal body sections together at least before impact with the target.

In a method as described above, the projectile comprises at least one exterior binding element at the tip and at the rear of the projectile that is made/structured to begin to rupture upon striking the target.

In a method as described above, the projectile comprises at least one exterior binding element at the tip and at the rear of the projectile that maintains the at least two longitudinal body sections in synchronized rotation. The at least one exterior binding element at the tip and at the rear of the projectile and the at least two longitudinal body sections concurrently rotate with one another in a common direction and synchronized manner as the projectile travels through and beyond a barrel of the firearm, such as during flight.

In a method as described above, the projectile fragments into at least two pieces upon penetration in soft tissue.

In a method as described above, the projectile has an exterior surface area of reduced contact with an internal surface of a firearm barrel, so as to improve at least some performance.

In a method as described above, the projectile comprises at least two longitudinal body sections further having correspondingly positioned sides disposed a predetermined spaced distance from one another, the space selected from spaces including spaces that are empty/hollow, spaces that contain at least some of at least one supplemental payload, spaces that contain at least some of at least one longitudinal body section, and spaces that contain at least some of a wedge shape, and spaces that contain at least some of a penetrable projectile tip, and any combinations thereof.

In a method as described above, the at least one supplemental payload is contained within a central/interior cavity of the projectile to protect the at least one supplemental payload from reacting before reaching the target.

In a method as described above, the projectile is further associated with at least one additional supplemental payload and is structured to deliver the at least one additional supplemental payload to/within a target, the at least one additional supplemental payload selected from payloads, including, but not limited to, at least one chemical substance, at least one chemical formulation, at least one dye, at least one isotope, at least one electronic circuit, at least one RFID tag, at least one tracer element, at least one transmitter, at least one tracking transmitter, at least one power source, such as a battery, at least one explosive material, at least one remote detonator, at least one SPLAT, Sticky Polymer Lethal Agent Tag, at least one Smartdust, or any combinations thereof.

In a method as described above, the projectile is further associated with at least two supplemental payloads and is structured to deliver the at least two supplemental payloads to/within a target, the at least two supplemental payloads further having a synergistic combination/effect.

In a method as described above, the projectile is associated with an ammunition cartridge prior to the firing/discharging from the firearm.

As such, the invention includes methods of firing/discharging a projectile from a firearm loaded with an ammunition cartridge comprised of the projectile so as to deliver to/within a target an at least one supplemental payload to cause damage inside of the target additional to impact and penetration of the projectile. The at least one supplemental payload is preferably released from a central/interior, non-peripheral cavity of the projectile when an at least two longitudinal body sections of the projectile separate inside of the target. Ideally, the projectile is radially sectioned and longitudinally sectioned lengthwise along its longitudinal length by being divided by at least one plane in a tip-to-rear/front-to-back direction of the projectile; the projectile comprising at least two penetrable longitudinal body sections. The projectile preferably further comprises at least one exterior binding element at the tip and at the rear of the projectile that holds the at least two longitudinal body sections together at least before impact with the target and is made/structured to begin to rupture upon striking the target. The at least one supplemental payload preferably comprises an at least one reactive chemical substance or explosive material not involved in the firing or propulsion of the projectile to the target. The at least one supplemental payload is contained within a central/interior, non-peripheral cavity of the projectile to protect the at least one supplemental payload from contact with/exposure to the projectile's exterior before reaching the target and from reacting before reaching the target.

The invention also includes methods of exposing/releasing at least one supplemental payload inside of a target from a longitudinally sectioned projectile. The longitudinally sectioned projectile is a projectile that is longitudinally sectioned lengthwise along its longitudinal length by being divided by at least one plane in a tip-to-rear/front-to-back direction. The at least one supplemental payload preferably comprises an at least one reactive chemical substance or explosive material not involved in the firing or propulsion of the longitudinally sectioned projectile to the target. The at least one supplemental payload is preferably contained within a central/interior section or cavity of the longitudinally sectioned projectile to protect the at least one supplemental payload from contact with/exposure to the longitudinally sectioned projectile's exterior before reaching the target and from reacting before reaching the target. The method further comprising the at least one supplemental payload reacting inside of the target to cause damage additional to damage caused by an impact and penetration of the longitudinally sectioned projectile.

In this method, it is preferable for the projectile to further comprise an at least one exterior binding element at the tip and at the rear of the projectile that holds the at least two longitudinal body sections together at least before impact with the target and is made/structured to rupture upon striking the target.

The above methods provide an efficient means of delivering at least one supplemental payload, such as a reactive chemical substance or explosive material, to/within a target, such as a combatant human target, to ensure lethality of the projectile, such as in times of war, by causing damage beyond the impact and penetration of the projectile when the payload reacts inside the target; damage beyond that of a bullet wound. Such damage caused by the supplemental payload includes damage selected from tissue damage, interference with bodily function, and excessive bleeding. Even so, the separation, movement, and rotation of the longitudinal body sections of the projectile inside the target also causes wider-spread physical damage beyond that of a standard bullet ammunition. The enhanced lethality of the projectiles and methods of the invention are ideal for advanced sniper rounds in taking out a target of interest with a single shot.

The above methods provide a means of protecting the supplemental payload within the projectile, thereby preventing the supplemental payload from reacting with and/or being damaged from the projectile's external environment before the projectile reaches the intended target.

Ideally, the above methods allow the supplemental payload to be released or at least be exposed to the interior contents of the target, with such release or exposure occurring deep within the target as the longitudinal sections of the projectile separate ideally well after penetrating the target.

The supplemental payload can remain associated with at least one longitudinal body section after penetration, or the supplemental payload can become free of any and all projectile body sections after projectile penetration.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A penetrable projectile structured to be discharged from a firearm, said penetrable projectile being formed with an exterior surface having a circular cross section and a central longitudinal axis, said penetrable projectile having a plurality of axial cuts extending along a length of said penetrable projectile from/near the central longitudinal axis of said penetrable projectile to the exterior surface dividing said penetrable projectile into a plurality of penetrable individual longitudinal body sections having similar configurations, said penetrable projectile thereby being radially sectioned and longitudinally sectioned along a longitudinal length by being divided by at least one plane in a tip-to-rear/front-to-back direction of said penetrable projectile, said penetrable projectile comprising at least two penetrable individual longitudinal body sections, said at least two penetrable individual longitudinal body sections being of identical size and shape, said at least two penetrable individual longitudinal body sections each having at least one width approximately equal to a cross sectional radius of said penetrable projectile when assembled, said penetrable projectile further comprising at least two exterior binding elements, including at the tip and at the rear of said penetrable projectile, that hold said at least two penetrable individual longitudinal body sections together at least until impact with a predetermined target, said at least two penetrable individual longitudinal body sections separating away from each other inside of said predetermined target and causing further damage inside of said predetermined target after said at least two exterior binding elements rupture.

2. The penetrable projectile of claim 1, wherein at least one of said at least two exterior binding elements comprises an at least partial bullet jacket.

3. The penetrable projectile of claim 1, wherein at least one of said at least two exterior binding elements is configured to rupture upon striking said predetermined target.

4. The penetrable projectile of claim 1, wherein at least two penetrable individual longitudinal body sections are symmetrical to each other.

5. The penetrable projectile of claim 1, wherein at least two penetrable individual longitudinal body sections are nonsymmetrical to at least one additional penetrable individual body section.

6. The penetrable projectile of claim 1, further including symmetrical and nonsymmetrical penetrable individual body sections.

7. The penetrable projectile of claim 1, at least partially longitudinally sectioned from a central/primary longitudinal axis.

8. The penetrable projectile of claim 1, at least partially longitudinally sectioned from a non-central longitudinal axis.

9. The penetrable projectile of claim 1, at least partially longitudinally sectioned from at least one additional longitudinal axis.

10. The penetrable projectile of claim 1, wherein at least one penetrable individual longitudinal body section has a surface interior to the projectile that is at least partially tilted/skewed from a longitudinal axis.

11. The penetrable projectile of claim 1, at least partially longitudinally sectioned from a tilted/skewed axis.

12. The penetrable projectile of claim 1, wherein at least one penetrable individual longitudinal body section spans a full length of the penetrable projectile.

13. The penetrable projectile of claim 1, wherein at least one penetrable individual longitudinal body section has a length less than a full length of the penetrable projectile and does not span the full length of the penetrable projectile.

14. The penetrable projectile of claim 1, wherein at least two penetrable individual longitudinal body sections span a full width of the penetrable projectile when assembled.

15. The penetrable projectile of claim 1, wherein at least two penetrable individual longitudinal body sections have a width less than a full width of the penetrable projectile and do not span the full width of the penetrable projectile along at least a portion of a length of the penetrable projectile when the penetrable projectile is assembled.

16. The penetrable projectile of claim 1, wherein the penetrable projectile has at least one additional exterior binding element chosen from frontal binding elements, midsection binding elements, and rear binding elements.

17. The penetrable projectile of claim 1, wherein the penetrable projectile has at least one at least partial bullet jacket chosen from frontal jacket sections, middle jacket sections, and rear jacket sections.

18. The penetrable projectile of claim 1, wherein the penetrable projectile has a full bullet jacket.

19. The penetrable projectile of claim 1, wherein the penetrable projectile has no bullet jacket.

20. The penetrable projectile of claim 1, wherein the penetrable projectile has a mid-section including at least one annular groove or irregular surface feature integrally formed in an exterior surface of the mid-section.

21. The penetrable projectile of claim 1, wherein the penetrable projectile has a mid-section including at least one tapered configuration.

22. The penetrable projectile of claim 1, wherein the penetrable projectile has at least one exterior binding element, said exterior binding element having an at least partially tapered profile, and said exterior binding element being configured to at least partially enclose the penetrable individual longitudinal body sections and to facilitate gripping engagement of said exterior binding element with the penetrable individual longitudinal body sections.

23. The penetrable projectile of claim 1, wherein the penetrable projectile has at least one exterior binding element, said exterior binding element including at least one inwardly directed, somewhat interior peripheral rim configured to securely engage the binding element and at least one penetrable individual longitudinal body section.

24. The penetrable projectile of claim 1, wherein the penetrable projectile has at least one exterior binding element chosen from annular shoulders, conical-shaped binding elements, ogive-shaped binding elements, tubular-shaped binding elements, and cup-shaped binding elements.

25. The penetrable projectile of claim 1, wherein at least one penetrable individual longitudinal body section is formed from at least one material selected from metals, aluminum, antimony, beryllium, bismuth, boron carbide, brass, bronze, chromium, cobalt, copper, gold, iridium, iron, lead, magnesium, mercury, molybdenum, nickel, palladium, platinum, rhodium, silicon carbide, silver, steel, tantalum, tellurium, tin, titanium, tungsten, tungsten carbide, depleted uranium, zinc, zirconium, metal alloys, carbon-fiber, polymers, polymer-metal composites, thermoplastic and metal powders, and combinations thereof.

26. The penetrable projectile of claim 1, wherein at least one exterior binding element is formed from at least one material selected from metals, aluminum, bronze, brass, chromium, copper, epoxy, fiberglass, Kevlar, gold, graphite, iron, lead, magnesium, mercury, molybdenum, nickel, nylon, palladium, polycarbonate, polyester, polyethylene, polystyrene, polyamide, poly vinyl chloride, polyurethane, phenolic, thermoplastic polymer, thermoset polymer, rhodium, rubber, silicon, silver, steel, tantalum, tellurium, tin, titanium, Teflon, Torlon, Ultem, zinc, zirconium, metal alloys, carbon-fiber, polymers, polymer-metal composites, thermoplastic and metal powders, and combinations thereof.

27. The penetrable projectile of claim 1, wherein the penetrable projectile is substantially free of lead.

28. The penetrable projectile of claim 1, wherein at least one exterior binding element is formed from at least one material selected from hard materials, soft materials, rigid materials, semi-rigid materials, pliable materials, frangible materials, non-frangible materials, and combinations thereof.

29. The penetrable projectile of claim 1, wherein at least one of said at least two penetrable individual longitudinal body sections is removably connected to and separable from at least one of said at least two exterior binding elements upon said penetrable projectile striking and penetrating said predetermined target.

30. The penetrable projectile of claim 1, wherein each of said at least two penetrable individual longitudinal body sections is removably connected to and separable from said at least two exterior binding elements upon said penetrable projectile striking and penetrating said predetermined target.

31. The penetrable projectile of claim 1, wherein at least one of said at least two exterior binding elements comprises an at least partially hollow interior, the interior dimensioned and configured to receive at least one of said at least two penetrable individual longitudinal body sections therein through an at least partially open end of the exterior binding elements.

32. The penetrable projectile of claim 1 including at least one additional penetrable individual body section.

33. The penetrable projectile of claim 1 that further includes at least one additional penetrable individual body section other than a penetrable individual longitudinal body section.

34. The penetrable projectile of claim 1 including at least one discharge reinforcing element that provides the penetrable projectile with structural reinforcement during firing from a firearm.

35. The penetrable projectile of claim 1 wherein said at least two penetrable individual longitudinal body sections include at least one set of at least partially interlocking prong-like elements along internally facing surfaces of the at least two penetrable individual longitudinal body sections.

36. The penetrable projectile of claim 1, wherein said at least two penetrable individual longitudinal body sections include correspondingly positioned sides disposed in confronting engagement with one another on an interior of at least one of said at least two exterior binding elements.

37. The penetrable projectile of claim 1, wherein said at least two penetrable individual longitudinal body sections include correspondingly positioned sides disposed a spaced distance from one another within at least one of said at least two exterior binding elements to form a cavity, wherein the cavity is configured to remain empty or to receive at least a portion of one or more of at least one supplemental payload, at least one penetrable individual longitudinal body section, a wedge section, and a penetrable projectile tip.

38. The penetrable projectile of claim 1, wherein the penetrable projectile is associated with at least one additional penetrable individual body section, said at least one additional penetrable individual body section being radially centered in relation to at least one penetrable individual longitudinal body section.

39. The penetrable projectile of claim 1 wherein the penetrable projectile is further associated with at least one additional penetrable individual body section, said at least one additional penetrable individual body section is at least one of partially wedge-shaped and rounded and located at least somewhat between said at least two penetrable individual longitudinal body sections so as to help further separate the at least two penetrable individual longitudinal body sections after striking said predetermined target.

40. The penetrable projectile of claim 1 wherein the penetrable projectile is further associated with at least one additional penetrable individual body section, said at least one additional penetrable individual body section is at least one of partially wedge-shaped and rounded and located at least somewhat between said at least two penetrable individual longitudinal body sections including at/near the front/tip of said penetrable projectile so as to help rupture said exterior binding element at the tip of said penetrable projectile after striking said predetermined target and to help further separate the at least two penetrable individual longitudinal body sections while penetrating said predetermined target, and influencing kinetic energy redistribution and or separate trajectories among penetrable individual body sections of said penetrable projectile inside said predetermined target, and reducing target exiting potential of said penetrable individual body sections.

41. The penetrable projectile of claim 1, wherein at least two exterior binding elements are at least partially connected to each other, or are conjoined or formed as one exterior binding element.

42. The penetrable projectile of claim 1, wherein the penetrable projectile is associated with at least one supplemental payload and is structured to deliver said at least one supplemental payload to said predetermined target.

43. The penetrable projectile of claim 1, wherein at least one of said at least two penetrable individual longitudinal body sections is structured to receive at least a portion of at least one supplemental payload in an interior cavity of the at least one penetrable individual longitudinal body section.

44. The penetrable projectile of claim 1, wherein the penetrable projectile is associated with at least one supplemental payload and is structured to deliver said at least one supplemental payload to said predetermined target, said at least one supplemental payload selected from at least one chemical substance, at least one chemical formulation, at least one dye, at least one isotope, at least one electronic circuit, at least one RFID tag, at least one tracer element, at least one transmitter, at least one tracking transmitter, at least one power source, at least one explosive material, at least one remote detonator, at least one Sticky Polymer Lethal Agent Tag (SPLAT), at least one Smartdust, at least one reactive material, or any combination thereof.

45. The penetrable projectile of claim 1, wherein the penetrable projectile is associated with at least two supplemental payloads and is structured to deliver said at least two supplemental payloads to said predetermined target, said at least two supplemental payloads having a synergistic effect.

46. The penetrable projectile of claim 1, wherein at least one of said at least two exterior binding elements maintains said at least two penetrable individual longitudinal body sections in common direction and synchronized rotation during use.

47. The penetrable projectile of claim 1, wherein the penetrable projectile fragments into at least two pieces upon penetration in soft tissue.

48. The penetrable projectile of claim 1, wherein the penetrable projectile has an exterior surface area of reduced contact with an internal surface of the firearm barrel.

49. The penetrable projectile of claim 1, wherein an exterior surface of at least one penetrable individual longitudinal body section is spaced apart from an interior surface of at least one exterior binding element that at least partially sheaths said at least one penetrable individual longitudinal body section.

50. A penetrable projectile structured to be discharged from a firearm, said penetrable projectile being formed with an exterior surface having a circular cross sectional configuration and at least one longitudinal axis, said penetrable projectile having a plurality of axial cuts extending along a length of said penetrable projectile from said at least one longitudinal axis of said penetrable projectile to the exterior surface dividing said penetrable projectile into a plurality of similarly configured sections, penetrable individual longitudinal body sections, said penetrable projectile thereby being longitudinally sectioned lengthwise along a longitudinal length by being divided by at least one plane in a tip-to-rear/front-to-back direction of said penetrable projectile, said penetrable projectile comprising at least two penetrable individual longitudinal body sections, said at least two penetrable individual longitudinal body sections being of identical size and shape, said at least two penetrable individual longitudinal body sections each having at least one width approximately less than a cross sectional radius of said penetrable projectile when assembled, said penetrable projectile further comprising at least two exterior binding elements, including at the tip and at the rear of said penetrable projectile, that hold said at least two penetrable individual longitudinal body sections together at least until impact with a predetermined target, said at least two penetrable individual longitudinal body sections separating away from each other inside of said predetermined target and causing further damage inside of said predetermined target after said at least two exterior binding elements rupture, said penetrable projectile further comprising at least one additional penetrable individual body section, said at least one additional penetrable individual body section being centered around a central longitudinal axis of said penetrable projectile, said at least one additional penetrable individual body section helping to begin to rupture said exterior binding element at the tip of said penetrable projectile upon striking said predetermined target, said at least one additional penetrable individual body section helping to further separate said at least two penetrable individual longitudinal body sections after striking and penetrating said predetermined target and after said exterior binding element at the tip of said penetrable projectile ruptures.

51. A penetrable projectile structured to be discharged from a firearm, said penetrable projectile comprising a longitudinally sectioned body of at least two body sections, said at least two body sections being at least partial radial sections of said penetrable projectile, each of said at least two body sections comprising at least one interior surface that runs in the tip-to-rear/front-to-back direction of said penetrable projectile, said penetrable projectile further comprising at least one binding/holding element, including at least at the frontal region of said penetrable projectile, and disposed in radially surrounding relation to said at least two body sections, said at least one binding/holding element structured to provide controlled rupturing of said at least one binding/holding element responsive to said penetrable projectile striking and penetrating a predetermined target, said at least one binding/holding element maintaining said at least two body sections in synchronized rotation while being fixedly secured to one another by said at least one binding/holding element whereby upon said penetrable projectile striking said predetermined target said at least one binding/holding element begins to rupture in an at least partially controlled fashion, after said at least one binding/holding element ruptures said at least two body sections of said penetrable projectile separating inside of said predetermined target and causing further damage inside of said predetermined target.

52. An ammunition cartridge comprising a penetrable lethal projectile slideably disposed within said ammunition cartridge, said penetrable lethal projectile structured to be discharged from a firearm, said penetrable lethal projectile being radially sectioned and longitudinally sectioned lengthwise along a longitudinal length by being divided by at least one plane in a tip-to-rear/front-to-back direction of said penetrable lethal projectile, said penetrable lethal projectile comprising at least two non-fused penetrable individual solid metal longitudinal body sections, said penetrable lethal projectile further comprising at least one outer/exterior binding element, including at least at/near the tip/frontal region of said penetrable lethal projectile, that holds said at least two non-fused penetrable individual solid metal longitudinal body sections together at least until impact with a target, said at least two non-fused penetrable individual solid metal longitudinal body sections further separating away from each other inside of said target and causing widespread damage inside of said target after said at least one exterior binding element ruptures.

53. An ammunition cartridge comprising a penetrable lethal projectile slideably disposed within said ammunition cartridge, said penetrable lethal projectile structured to be discharged from a firearm, said penetrable lethal projectile being formed with an exterior surface having a circular cross sectional configuration and at least one longitudinal axis, said penetrable lethal projectile having a plurality of axial cuts extending along a length of said penetrable lethal projectile from said at least one longitudinal axis of said penetrable lethal projectile to the exterior surface dividing said penetrable lethal projectile into a plurality of similarly configured sections, non-fused penetrable individual solid metal longitudinal body sections, said penetrable lethal projectile thereby being longitudinally sectioned lengthwise along a longitudinal length by being divided by at least one plane in a tip-to-rear/front-to-back direction of said penetrable lethal projectile, said penetrable lethal projectile comprising at least two non-fused penetrable individual solid metal longitudinal body sections, said at least two non-fused penetrable individual solid metal longitudinal body sections being of identical size and shape, said at least two non-fused penetrable individual solid metal longitudinal body sections each having at least one width approximately less than a cross sectional radius of said penetrable lethal projectile when assembled, said penetrable lethal projectile further comprising at least one frontal exterior binding element, including at least at/near the tip of said penetrable lethal projectile, that holds said at least two non-fused penetrable individual solid metal longitudinal body sections together at least until impact with a predetermined target, said at least two non-fused penetrable individual solid metal longitudinal body sections separating away from each other inside of said predetermined target and causing further damage inside of said predetermined target after said at least one frontal exterior binding element ruptures, said penetrable lethal projectile further comprising at least one additional penetrable individual body section, said at least one additional penetrable individual body section being hard and centered around a central longitudinal axis of said penetrable lethal projectile, said at least one additional penetrable individual body section helping to further separate said at least two non-fused penetrable individual solid metal longitudinal body sections after striking said predetermined target and after said frontal exterior binding element at/near the tip of said penetrable lethal projectile ruptures.

* * * * *